US011590400B2

(12) United States Patent
Harley

(10) Patent No.: US 11,590,400 B2
(45) Date of Patent: Feb. 28, 2023

(54) COMPACT BALL LAUNCHING SYSTEM AND ASSOCIATED METHODS

(71) Applicant: Hydrogen Sports LLC, Los Gatos, CA (US)

(72) Inventor: Jonah Harley, Los Gatos, CA (US)

(73) Assignee: Hydrogen Sports LLC, Los Gatos, CA (US)

( * ) Notice: Subject to any disclaimer, the term of this patent is extended or adjusted under 35 U.S.C. 154(b) by 0 days.

(21) Appl. No.: 16/903,112

(22) Filed: Jun. 16, 2020

(65) Prior Publication Data

US 2020/0398139 A1 Dec. 24, 2020

Related U.S. Application Data

(60) Provisional application No. 62/863,462, filed on Jun. 19, 2019.

(51) Int. Cl.

| | |
|---|---|
| ***A63B 65/12*** | (2006.01) |
| ***F41J 9/18*** | (2006.01) |
| ***A63B 69/40*** | (2006.01) |

(52) U.S. Cl.

CPC ..... *A63B 69/406* (2013.01); *A63B 65/12* (2013.01); *A63B 69/40* (2013.01);
(Continued)

(58) Field of Classification Search

CPC ..... A63B 65/12; A63B 2225/09; F41J 9/18; B65D 21/085; B65D 21/0212
(Continued)

(56) References Cited

U.S. PATENT DOCUMENTS 3,665,910 A * 5/1972 Boni ..... A63B 69/0026 124/73
3,777,732 A 12/1973 Peeler et al.
(Continued)

FOREIGN PATENT DOCUMENTS

DE 2945588 5/1981
GB 9596000 * 6/1964 ..... B60Q 7/005

OTHER PUBLICATIONS

Lobster Grande 5 LE Owner's Manual. Lobster Sports, Published on or before Jun. 19, 2019 (16 pgs).
(Continued)

*Primary Examiner* — John E Simms, Jr.
(74) *Attorney, Agent, or Firm* — John P. Davis; Thayne and Davis LLC

(57) ABSTRACT

This disclosure relates to a relatively compact smart ball launching system and associated methods for using the same. In various embodiments, the disclosed ball launching system may comprise a collapsible ball hopper that can store a larger number of balls while maintaining a relatively compact size. In certain embodiments, brushless motors may be used to improve power efficiency while allowing for accurate launch speeds and/or spins. In some embodiments, a pre-launch chamber may be included in a ball dispensing mechanism that may facilitate on-demand shots and/or power savings by shutting the ball launching system down when the ball hopper is empty. In further embodiments, the ball launching system may be controlled, at least in part, via a mobile device. In some implementations, the ball launching system may include and/or otherwise interface with a camera system to facilitate improved calibration and/or record user actions.

21 Claims, 16 Drawing Sheets

(52) U.S. Cl.
CPC ..... *A63B 2210/50* (2013.01); *A63B 2220/18* (2013.01); *A63B 2220/40* (2013.01); *A63B 2220/833* (2013.01); *A63B 2225/02* (2013.01); *A63B 2225/09* (2013.01); *A63B 2225/50* (2013.01); *F41J 9/18* (2013.01)

(58) Field of Classification Search
USPC ..... 124/78
See application file for complete search history.

(56) References Cited

U.S. PATENT DOCUMENTS

| | | | | |
|---|---|---|---|---|
| 3,913,552 | A | 10/1975 | Yarur et al. | |
| 4,025,071 | A * | 5/1977 | Hodges | A63B 69/406 473/436 |
| 4,086,903 | A | 5/1978 | Scott | |
| 4,116,192 | A * | 9/1978 | Scott | A63B 47/025 124/51.1 |
| 4,442,823 | A | 4/1984 | Floyd et al. | |
| 4,563,999 | A * | 1/1986 | Miehlich | A63B 69/40 124/78 |
| 4,570,607 | A | 2/1986 | Doeg | |
| 4,712,534 | A | 12/1987 | Nozato | |
| 4,834,060 | A * | 5/1989 | Greene | A63B 69/406 124/78 |
| 5,107,820 | A * | 4/1992 | Salansky | A63B 69/40 124/78 |
| 5,125,653 | A * | 6/1992 | Kovacs | A63B 69/406 124/78 |
| 5,472,107 | A * | 12/1995 | Lieber | B65D 1/225 220/6 |
| 5,490,493 | A | 2/1996 | Salansky | |
| 5,641,080 | A * | 6/1997 | Humphrey | A47B 49/004 211/163 |
| 5,649,523 | A * | 7/1997 | Scott | A63B 69/406 124/78 |
| 5,749,797 | A * | 5/1998 | Sunseri | A63B 69/407 124/16 |
| 6,074,298 | A * | 6/2000 | Majkrzak | A01D 41/1208 460/119 |
| D456,866 | S | 5/2002 | Turpault | |
| 7,445,003 | B2 | 11/2008 | Smith | |
| 7,610,909 | B2 | 11/2009 | Greene, Jr. | |
| D641,437 | S | 7/2011 | Nugent | |
| 8,651,309 | B2 * | 2/2014 | Gualersi | B65D 11/1833 220/613 |
| 9,022,016 | B1 * | 5/2015 | Hafer | F41B 4/00 124/78 |
| D748,349 | S | 1/2016 | Hussey et al. | |
| 11,201,275 | B1 * | 12/2021 | Chua | H01L 39/02 |
| 2005/0056643 | A1 * | 3/2005 | Hagan | A45C 7/0077 220/9.3 |
| 2005/0087530 | A1 * | 4/2005 | Svenson | B60R 7/02 220/6 |
| 2013/0104870 | A1 * | 5/2013 | Rizzo | A63B 69/38 124/78 |
| 2013/0228138 | A1 * | 9/2013 | Hamill | A01K 15/025 119/707 |
| 2014/0118118 | A1 | 5/2014 | Hanseen et al. | |
| 2014/0121043 | A1 | 5/2014 | Blanning | |
| 2015/0122196 | A1 * | 5/2015 | Liu | A01K 1/0157 119/497 |
| 2015/0321059 | A1 * | 11/2015 | Hussey | A01K 15/027 119/707 |
| 2017/0129695 | A1 * | 5/2017 | Utz | B65D 90/008 |
| 2017/0326428 | A1 * | 11/2017 | Qian | A63B 69/406 |
| 2020/0108826 | A1 * | 4/2020 | Kim | B60W 60/0017 |
| 2020/0197781 | A1 * | 6/2020 | Rocas Alonso | A63B 69/406 |
| 2020/0290520 | A1 * | 9/2020 | Lim | B60R 9/045 |

OTHER PUBLICATIONS

Lobster Sports Application Screenshots. Lobster Sports, Published on or before Jun. 19, 2019 (3 pgs).
Lobster Sports—Repair Instructions. Replacing and Installing a New Sensor Disc. Published on or before Jun. 19, 2019 (3 pgs).
Playmate IGenie Owner's Manual. Metaltek. Published 2018. (28 pgs).
Playmate Like My Drill Application Screenshots. Metalek. Published on or before Jun. 19, 2019 (8 pgs).
Spinshot Plus-2 Owner's Manual. Spinshot Sports, Published on or before Jun. 19, 2019 (20 pgs).
Website. Sports Tutor Tennis Machines, https://sportstutor.com. Accessed on or before Jun. 19, 2019 (3 pgs).
DE2945588, Koellner et al., Published May 21, 1981, Machine Translation (3 pgs).

* cited by examiner

COMPACT BALL LAUNCHING SYSTEM AND ASSOCIATED METHODS

RELATED APPLICATION

This application claims the benefit of priority under 35 U.S.C. § 119(e) to U.S. Provisional Patent Application No. 62/863,462, filed Jun. 19, 2019, and entitled "Compact Ball Machine with Sensors for Advanced Operation," which is hereby incorporated by reference in its entirety.

TECHNICAL FIELD

The present disclosure relates generally to ball launching systems. More specifically, but not exclusively, the present disclosure relates to relatively compact ball launch systems and associated methods that may include, among other features, expandable ball hopper designs and/or sensors enabling advanced operations and/or control.

SUMMARY

Machines to throw or shoot balls or birdies are available for many sports, including tennis, baseball, ping-pong, football, soccer, squash and badminton. Such machines typically include counter-rotating wheels that grab, compress, and launch the balls, as the rotating wheels can be a great store of energy and also allow the balls to be launched with different spins.

Conventional "portable" ball machines, however, are often heavy and difficult to move. For example, tennis ball machines from market leaders weigh often upwards of 35 pounds (~16 kgs) and have volumes in excess of 9,000 cubic inches (150,000 cubic cm). Such large machines typically include an extendable handle and rolling wheels to facilitate transportation. These features further increase the bulk and weight of the machine. Conventional ball machines that are smaller and lighter often have significantly reduced features and/or throwing ability.

Multi-axis ball machines may be capable of shooting balls left or right as well as higher and lower. The architecture of a conventional multi-axis machines may include a platform that is fixed to the ground, an outer gimbal or yoke that can rotate about a vertical axis (commonly called the azimuth angle) to aim left and right, and a second inner gimbal or yoke that can rotate about a horizontal axis (commonly called the altitude angle) to aim higher or lower. In many systems, azimuth rotation may involve moving the outer shell of the machine, but a fixed frame remains stationary on the ground. The altitude rotation is typically contained within the outer shell. The altitude and azimuth motion are sometimes controlled by motors in more sophisticated machines, but altitude in particular may also be controlled by a manual adjustment. This conventional architecture is an inefficient use of product volume, as the outer case must be large enough to contain the full movement of the inner gimbal, and have an aperture for ball exit which is also large enough to accommodate the full angular range of motion. Even if the outer case moves to aim the azimuth angle, space is still wasted by the additional fixed frame.

Many conventional ball launching machines require the entire machine to be moved near a power outlet for recharging. Moving a relatively heavy machine from a car to a house for charging is inconvenient, so some manufacturers offer external battery packs. Because current ball machines draw significant power, these battery packs themselves can often be in excess of 10 pounds, and are a separate item to move and connect for charging.

In many instances, the size of the ball hopper is another constraint preventing a truly portable machine. In conventional machines, the ball hopper is generally implemented in one of two ways. One option is for the outer shell of the machine to lift off and invert on top of the machine to create a bucket. If the machine is small, however, this does not provide adequate ball capacity for a good practice session. An alternate design is to have four panels on the top of the machine fold open to a vertical orientation, like the lid of a cardboard box, to create a ball hopper space on top of the machine. Again, this may not provide sufficient space if the machine is highly compact.

Certain conventional ball machines may use a rotating carousel to agitate the balls and force them to drop one-by-one into a channel which leads to the launching wheels. Dispensing balls without jams is a challenging puzzle, and is usually achieved with additional springs or plates to prevent more than a single ball entering the dispensing channel at a time. These springs and plates, however, add additional size and weight. If for some reason the next ball does not load in the carousel appropriately, a shot may be missed, and the user must wait another full shot interval for the subsequent ball. Moreover, many conventional machines use relatively tall fixed carousel, which contributes in part to the relative bulk of the machines.

If the transportation wheels and handle are removed from a lightweight machine to further save weight and space, an alternate means for holding and moving the machine is beneficial. A shoulder strap may serve this purpose, but in certain conventional machines, a long strap can block the exit port of the machine, disrupting the shots or even creating a hazardous situation.

In addition to the physical inconvenience of a heavy, bulky ball machine, most conventional ball machines also suffer from relatively primitive control interfaces. Typically a machine has knobs or buttons to control speed, spin, and feed rate. These controls offer only approximate control, so for each session the user must initially shoot some balls to dial in acceptable parameters. Even when the shots are calibrated, the interfaces for creating custom programs are either too confusing or lack the capability to fully control the shot parameters. Also, not all combinations of speed, spin and location may be physically possible (e.g., it may be exceedingly difficult for a high-speed shot with no spin may to land right behind the net) and it may be time consuming for the user to create valid practice routines.

Embodiments of the disclosed ball launching system and associated methods provide for a ball launching system that, among other things, ameliorates some and/or all of the limitations of conventional ball launching systems detailed above. In various embodiments, a ball launching system is described that may be more compact and of lighter weight than conventional systems without significantly sacrificing performance.

In certain embodiments, the disclosed ball launching system may comprise an expandable hopper than may quickly collapse to a relatively small size for transportation, but may be configured in an open confirmation offering increased ball capacity (e.g., holding at least 50 balls and potentially 100 or more). Further embodiments may offer improved energy consumption, allowing for the use of relatively small, removable battery packs. Some embodiments may incorporate a multi-piece carousel design allowing for the reduction in the height of the carousel mechanism during transport and/or storage while still allowing for improved ball agitation when configured for operation. Yet further embodiments provide for an easy interface to allow for users to create custom practice routines, potentially with guidance as to possible shots, and a system that can repeatably execute such routines with relatively little, if any, calibration.

Consistent with various embodiments disclosed herein, a ball launching system may include one or more of a highly compact expandable hopper; an architecture in which the entire system pivots laterally and tilts to aim the shots; sensors to accurately aim the shots; a smart ball feed system that loads balls into a pre-launch chamber where a ball is detected prior to launch via one or more sensors; a multi-piece carousel; relatively high-efficiency brushless motors that can accelerate and/or decelerate relatively quickly; a removable high-density battery pack; external indicators to communicate the system status while in use; and remote control via a mobile device application that enables relatively quick and intuitive input of shot parameters and can automatically calculate ball trajectories and display information about them.

In various disclosed embodiments, a ball launching system is provided. The ball launching system may include a hopper. The hopper may comprise a plurality of primary panels forming first sides of the hopper and a plurality of secondary panels forming second sides of the hopper. In some embodiments, each secondary panel of the plurality of secondary panels may interconnect sides of at least two primary panels. In further embodiments, the primary panels may comprise relatively rigid panels (e.g., plastic plates, panels with a relatively rigid wire frame with an inner face material that in some instances may be less rigid than the wire frame, and/or the like) and the secondary panels may comprise a material that is less rigid than the primary panels. In other embodiments, the secondary panels may also comprise a relatively rigid material.

In certain embodiments, the plurality of primary panels and the plurality of secondary panels are selectively configurable between a closed configuration and an open configuration. The hopper may have an increased ball capacity when the plurality of primary panels and the plurality of secondary panels are configured in the open configuration than when the plurality of primary panels and the plurality of secondary panels are configured in the closed configuration. In some embodiments, the plurality of primary panels and the plurality of secondary panels may be configured to fold (e.g., fold origami-style) relative to each other to change between the open configuration and the closed configuration.

A carousel may be disposed under the hopper configured receive one or more balls from the hopper. In some embodiments, the carousel may comprise a multi-piece carousel selectively configurable between an operating configuration and a storage configuration. For example, in various embodiments, the multi-piece carousel may comprise a top piece and a bottom piece. The top piece may be configured to nest within the bottom piece when the carousel is configured in a storage configuration. In some embodiments, a (e.g., a single and/or multi-piece carousel) may be used that detaches from the ball launching system for storage and/or transport.

The ball launching system may further comprise a ball dispensing mechanism configured to receive at least one ball of the one or more balls from the carousel and a launching mechanism configured to receive the at least one ball from the ball dispensing mechanism. The launching mechanism may include a plurality of motor-driven wheels configured to propel the at least one ball from the ball launching system. In some embodiments, the motor-driven wheels may be driven by one or more brushless motors.

In some embodiments, the ball dispensing mechanism may comprise a pre-launch chamber disposed under the carousel. The pre-launch chamber may be configured to receive the at least one ball from the carousel. A ball dispensing channel ball of the dispensing mechanism may be disposed between the pre-launch chamber and the plurality of motor-driven wheels of the ball launching mechanism. In various embodiments, the ball dispensing channel may be configured to receive the at least one ball from the pre-launch chamber and feed the at least one ball to the plurality of motor driven wheels.

In certain embodiments, the ball dispensing mechanism further comprises a dispense gate configured hold the at least one ball within the pre-launch chamber until the dispense gate is actuated to feed the at least one ball to the ball dispensing channel. A dispensing motor may be configured to actuate the carousel and the dispense gate. In further embodiments, separate motors and/or actuators (e.g., solenoids and/or the like) may be used to independently actuate the carousel and the dispense gate.

A ball detection sensor may be disposed proximate to the pre-launch chamber and be configured to detect whether a ball is present in the pre-launch chamber. Control electronics included in the ball launching system may be configured to actuate the dispensing motor (and/or a discrete actuation component) when the ball detection sensor detects that a ball is present in the pre-launch chamber. In some embodiments, the dispense gate may be actuated based on a control signal to launch a ball being received from a mobile device in communication with the ball launching system. The control electronics may further be configured to shut off the plurality of motor driven wheels if the ball detection sensor has not detected that a ball is present in the pre-launch chamber for a predetermined time period, which may indicate that the hopper is empty, thereby reducing the power consumption of the system under such conditions.

In some embodiments, the ball launching system may further comprise a ball jam detection system. For example, a ball jam detection sensor may be disposed proximate to the carousel and be configured to detect the occurrence of a ball jam condition. In further embodiments, control electronics may receive information from a motor configured to actuate the carousel (e.g., the ball dispensing motor) indicative of a ball jam condition (e.g., back-EMF may decrease with current increasing and/or the like). When a ball jam condition is detected, associated control electronics may be configured to reverse a rotational direction of a motor that actuates the carousel.

In various embodiments, a compact ball launching system may be achieved, at least in part, by al altitude adjustment mechanism and an azimuth adjustment mechanism that move the entirety of the machine and/or move the machine around a pivot point relative to a ground surface and/or field of play. In some embodiments, an altitude adjustment mechanism may be configured to selectively adjust an angle of a base of the ball launching system relative to a ground surface where the ball launching system is resting. In certain embodiments, a screw mechanism may be used for altitude adjustment, although other suitable mechanisms are also contemplated.

An azimuth adjustment mechanism may comprise at least one wheel and/or track in contact with the ground surface. The wheel and/or track may be configured to be selectively actuated by an azimuth adjustment motor. By selectively actuating the azimuth adjustment motor (and by extension, the associated wheel and/or track), the azimuth orientation of the ball launching system relative to the ground surface may be adjusted.

In certain embodiments, the ball launching system may include control electronics configured to actuate a first launching wheel motor configured to drive a first motor driven wheel of the plurality of motor driven wheels of the launching mechanism. The control electronics may be further configured to actuate a second launching wheel motor configured to drive a second motor-driven wheel of the plurality of motor driven wheels of the launching mechanism. In some embodiments, the control electronics may be configured to actuate the launching wheel motors based, at least in part, on control signals received from a mobile device in communication with the ball launching system. For example, the control electronics may direct the first and/or second launching wheel motors to rotate at a particular speed and/or engage in active breaking operations. In certain embodiments, a closed-loop feedback system may be employed by the control electronics to adjust a rotational speed of the launching wheel motor(s) with relative precision.

Control electronics of the ball launching system may further be configured to adjust an operating parameter of the ball launching system based, at least in part, on information received from one or more camera systems. In some embodiments, the camera system may be internal to and/or otherwise integrated the ball launching system. In further embodiments, the camera may comprise a separate camera system in communication with the ball launching system directly and/or via the mobile device.

BRIEF DESCRIPTION OF THE DRAWINGS

The inventive body of work will be readily understood by referring to the following detailed description in conjunction with the accompanying drawings, in which.

DETAILED DESCRIPTION

A detailed description of the systems and methods consistent with embodiments of the present disclosure is provided below. While several embodiments are described, it should be understood that the disclosure is not limited to any one embodiment, but instead encompasses numerous alternatives, modifications, and equivalents. In addition, while numerous specific details are set forth in the following description in order to provide a thorough understanding of the embodiments disclosed herein, some embodiments can be practiced without some or all of these details. Moreover, for the purpose of clarity, certain technical material that is known in the related art has not been described in detail in order to avoid unnecessarily obscuring the disclosure.

The embodiments of the disclosure may be understood by reference to the drawings, where in some instances, like parts may be designated by like numerals. The components of the disclosed embodiments, as generally described and illustrated in the figures herein, could be arranged and designed in a wide variety of different configurations. Thus, the following detailed description of the embodiments of the systems and methods of the disclosure is not intended to limit the scope of the disclosure, as claimed, but is merely representative of possible embodiments of the disclosure. In addition, the steps of any method disclosed herein do not necessarily need to be executed in any specific order, or even sequentially, nor need the steps be executed only once, unless otherwise specified.

Figure 1:
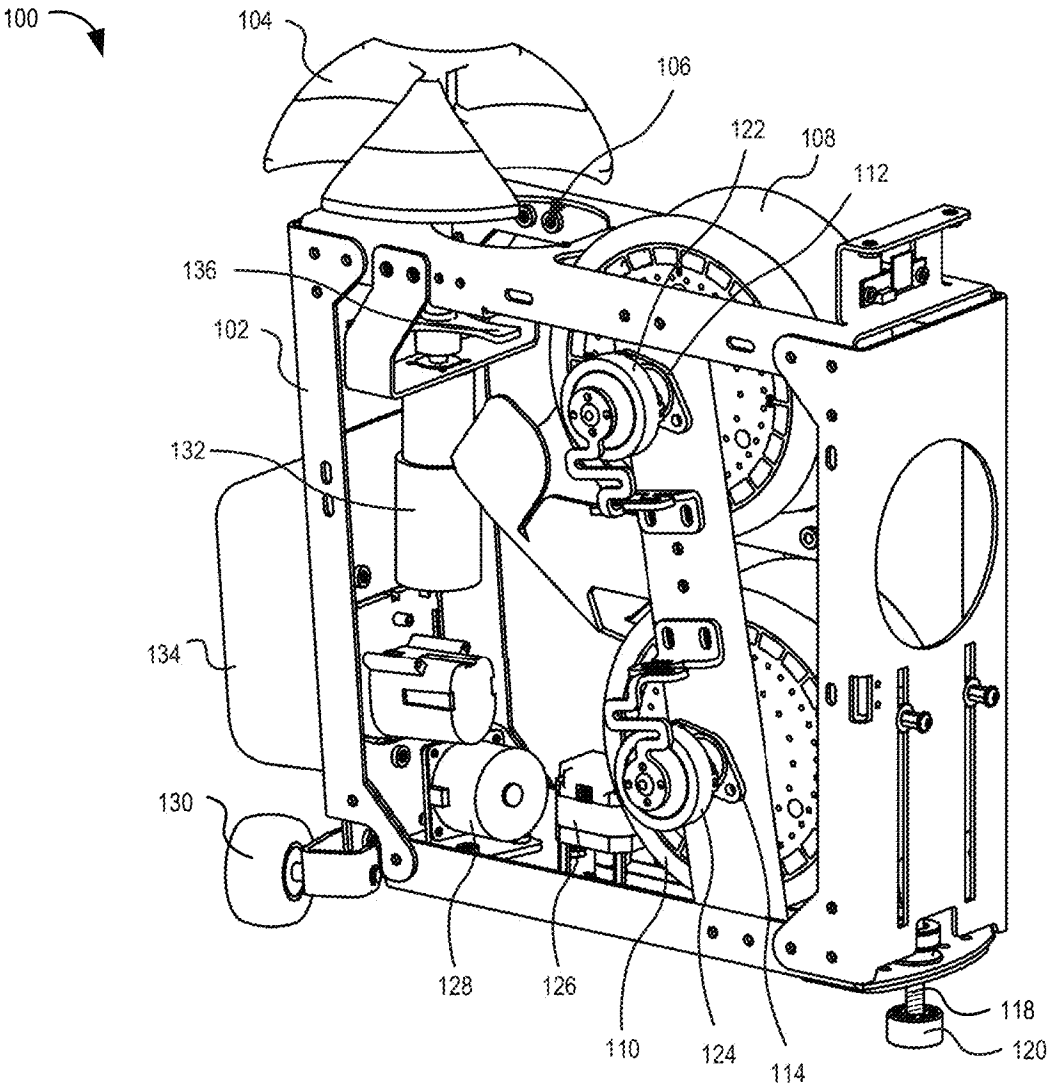
FIG. 1 illustrates an example of an internal mechanism of a ball launching system consistent with certain embodiments of the present disclosure.

FIG. 1 illustrates an example of an internal mechanism 100 of a ball launching system consistent with certain embodiments of the present disclosure. As shown, various components of the internal mechanism may be housed within and/or otherwise coupled to a frame 102. In some embodiments, the frame 102 may comprise a single component. In further embodiments, such as those illustrated in connection with FIG. 1, the frame 102 may comprise one or more separate components connected via any suitable method and/or mechanism to form the frame 102.

The frame 102 may, at least in part, provide a structure for the ball launching system. Various components described herein (e.g., motors, wheels, sensors, ball dispensing, ball launching, altitude adjustment, and/or azimuth adjustment mechanisms, and/or the like) may be mounted and/or otherwise coupled to suitable portions of the frame 102 using a variety of suitable connections based on the associated application.

In certain embodiments, the ball launching system may be capable of moving for azimuth and/or altitude positioning of shots. In some embodiments, and as described in more detail below, such positioning may be achieved via direct user control (e.g., using a smartphone and/or other mobile device and/or control interfaces such as knows and/or buttons of a control panel) and/or by autonomously executing one or more practice programs that, in some instances, may be defined and/or otherwise configured by a user (e.g., configured using a smartphone and/or other mobile device).

Altitude control may, in some embodiments, be achieved using an altitude adjustment mechanism that comprises one or more or more front lead screws 118 configured to lift and/or lower the front of the ball system relative to the rear of the ball system. In some embodiments, the lead screw 118 may be alternatively located at the rear of the ball launching system and be configured to lift and/or lower the rear of the ball system relative to the front of the ball system.

Figure 2:
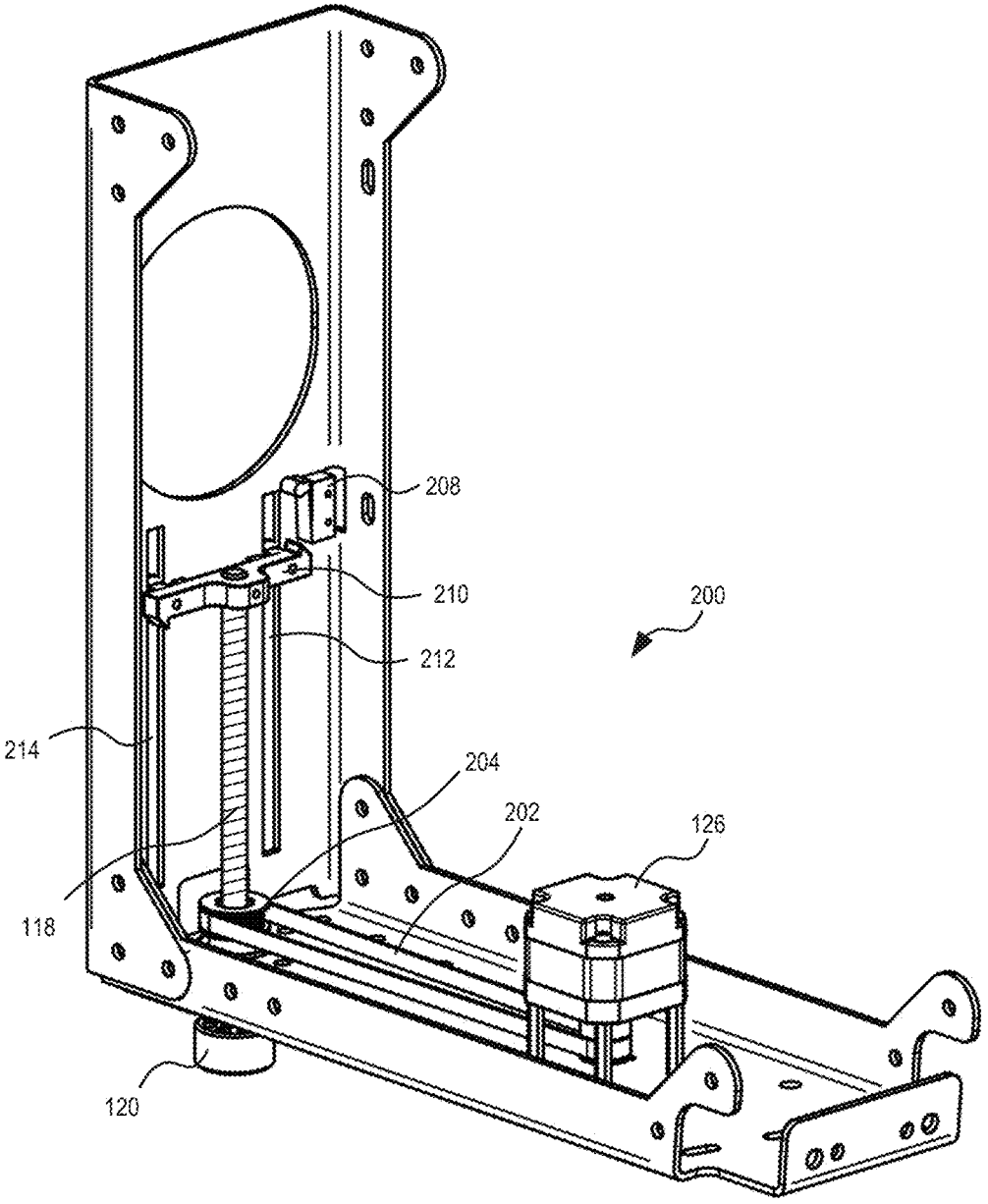
FIG. 2 illustrates an example of an altitude adjustment mechanism consistent with certain embodiments of the present disclosure.
Figure 3:
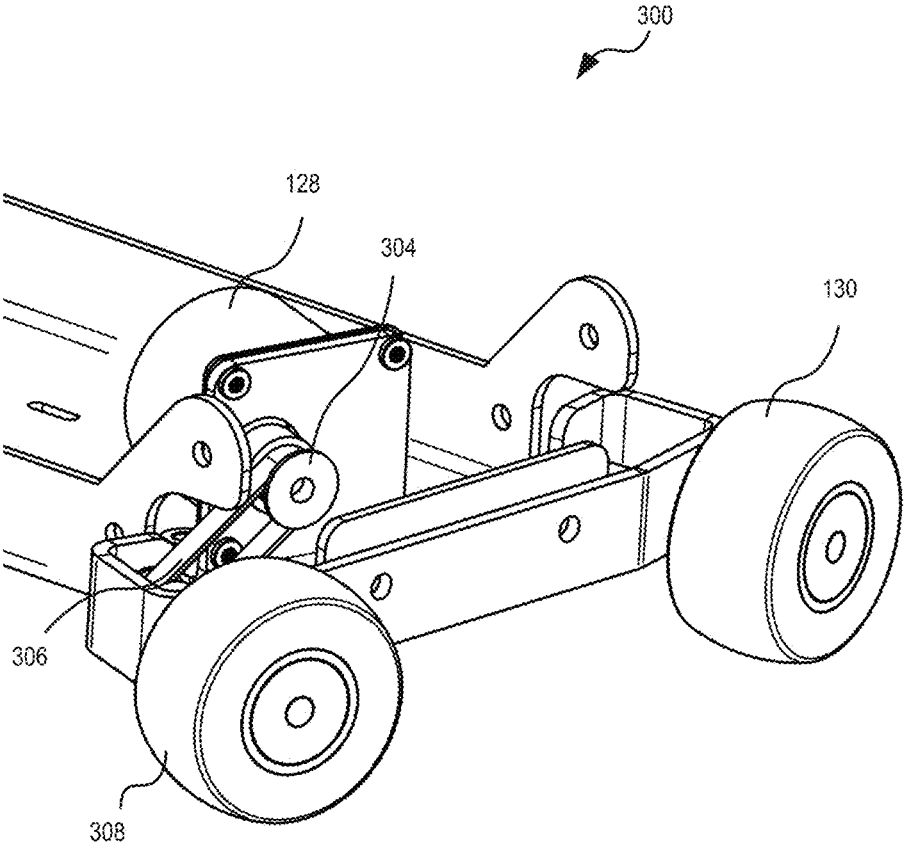
FIG. 3 illustrates an example of an azimuth adjustment mechanism consistent with certain embodiments of the present disclosure.

FIG. 2, discussed in more detail below, illustrates additional details of the altitude adjustment mechanism consistent with various disclosed embodiments. In some embodiments, azimuth control may be achieved using an azimuth adjustment mechanism that comprises one or more rear wheels 130 disposed on a rear of the ball system that, when actuated, allow azimuth rotation of the system about a front lead screw foot 120 that may be secured to a bottom of the front lead screw 118. In further embodiments, the azimuth adjustment mechanism may be located at a front of the ball launching system, with the altitude adjustment mechanism located at a rear of the system. FIG. 3, discussed in more detail below, illustrates additional details of the azimuth adjustment mechanism consistent with various disclosed embodiments.

Lead screw 118 may be driven by motor 126. Motor 126 may comprise, for example and without limitation, a stepper motor, a servo motor, a DC motor, and/or any other suitable type of motor. Referring to FIG. 2, which illustrates certain details of the altitude adjustment mechanism 200 consistent with certain embodiments, the motor 126 may drive the lead screw 118 via a belt drive 202, although other suitable mechanisms (e.g., direct drive mechanisms) are also contemplated. In some embodiments, the belt drive 202 may include gear reduction.

In certain embodiments, the motor 126 may be configured to turn a lead screw nut 204 (e.g., via the belt drive 202) that may be attached to a portion of the frame such that when the lead screw nut 204 is turned, the lead screw 118 is raised and/or lowered relative to the lead screw nut 204, thereby raising and/or lowering the front of the ball launching system relative to the rear and adjusting the altitude of the shot. To achieve this actuation control, the lead screw nut 204 may be attached to the frame of the ball mounting system using a flange-mounted bearing such as, for example and without limitation, a sleeve bushing and/or any other suitable mechanism.

The lead screw 118 may be prevented from rotating by bar 210, so that as the lead screw nut 204 turns, the lead screw 118 moves up and down, raising and/or lowering the front of the ball launching system relative to the rear. In some embodiments, the bar 210 may be constrained by one or more guide slots 212, 214, which may allow the bar 210 to move vertically within the guide slots 212, 214 without rotating.

In certain circumstances, stepper motors may lose steps if toque limits are exceeded. If this were to occur, it may be difficult to determine the actual altitude of the ball launching system. The altitude adjustment mechanism may therefore further comprise a limit switch 208. In some embodiments, the limit switch 208 may be triggered at a known altitude position (which may be a referred to as a "home" or a "parked position) so that the ball launching system may periodically move until the limit switch 208 is triggered and, based on the triggering of the limit switch 208, recalibrate the system to the known altitude. In further embodiments, altitude calibration may, alternatively and/or additionally, be accomplished using an accelerometer, an inclinometer, and/or any other suitable tilt sensor. In certain embodiments, using an accelerometer, an inclinometer, and/or another suitable tilt sensor may for allow for identifying conditions indicating that the ball launching system has inadvertently tipped over (or is horizontal for storage) and disabling the operation of the system under such conditions.

Referring back to FIG. 1, in some embodiments, azimuth control may be achieved using an azimuth adjustment mechanism that comprises one or more rear wheels 130 disposed on a rear of the ball launching system that, when actuated, allow azimuth rotation of the system about the front lead screw foot 120. One or more of the one or more real wheels 130 may be driven by motor 128. Motor 128 may comprise, for example and without limitation, a stepper motor, a servo motor, a DC motor, and/or any other suitable type of motor. Referring to FIG. 3, which illustrates certain details of the azimuth adjustment mechanism 300 consistent with certain embodiments, the motor 126 may be coupled will a pulley 304 actuating a belt 306 that drives rear wheel 308.

In certain embodiments, rear wheel 130 may be a passive "coaster" wheel that is not directly driven by the motor 126. In further embodiments, rear wheel 130 may also be driven. In some embodiments, the motor 126 (and/or other motors) may be configured to directly drive one or more of the wheels 130, 308 (e.g., without the use of a pulley and/or belt drive mechanism). In various embodiments, a gear reduction system may be incorporated into the azimuth adjustment mechanism 300 to increase to torque of the motor 128 in connection with azimuth positioning adjustments. In some embodiments, one or more pulleys (e.g., pulley 304) may provide a degree of gear reduction.

In some embodiments, one or more sensors in connection with the azimuth adjustment mechanism may be employed to help ensure repeatability of azimuth positioning operations. For example and without limitation, a compass and/or any other suitable sensor may be used to generate information relating to an azimuth position of the ball launching system that may be used in connection with operating and/or calibrating the azimuth adjustment mechanism. In certain applications (e.g., as may be the case with a tennis ball launching system), the ball launching system may be aligned to a reference azimuth position with lines included on a court of play as part of a system set up procedure (e.g., at the start of a practice session and/or the like).

Referring again to FIG. 1, the ball launching system may include a ball launching mechanism that comprises a plurality of motor-driven launching wheels 108, 110 configured to propel a ball from the ball launching system. To achieve high wheel velocity at moderate cost, many conventional ball machines use relatively heavy brushed DC motors that may, in some instances, weigh 2 pounds (~1 kg) each, if not more. To drive such large, relatively inefficient, motors in conventional battery powered ball machines, heavy high-capacity lead-acid batteries are typically used.

Consistent with various embodiments disclosed herein, high efficiency brushless DC launching motors 122, 124 may be used to drive one or more of the launching wheels 108, 110. In certain embodiments, brushless motors may use a micro-controller to synchronize the driving of the motor coils and may comprise high-performance neodymium magnets. In some implementations, brushless DC motors may achieve better efficiency (e.g., ~30% over conventional brushed DC motors) with lighter weight than conventional brushed DC motors. For example, certain a 300-gm brushless DC motor may perform similarly in some circumstances to a 1 kg brushed DC motor while still affording efficiency gains. Although certain embodiments described herein may use relatively high efficiency brushless DC motors, it will be appreciated that a variety of other types of motors may be used in connection with certain disclosed embodiments including, for example and without limitation, brushed DC motors.

Although two launching wheels 108, 110 are shown, each driven by its own launching motor 122, 124, in further embodiments, additional launching wheels, which may or may not be driven by their own associated motors, may be employed. Furthermore, although each launching wheel 108, 110 is illustrated as being driven by an associated launching motor 122, 124, it will be appreciated that in further embodiments, at least one of the launching wheels 108, 110 may not necessarily be directly motor driven and/or may be coupled (e.g., via a belt and/or gear) so that both wheels are driven by a single motor.

In some embodiments, internal bearings of the launching motors 122, 124 may not be capable of supporting relatively large torques. To facilitate operation with relatively large torques, wheels 108, 110 may be supported by their own bearings 112, 114. In some embodiments, each wheel 108, 110 may be supported by at least one bearing on each side, although further embodiments may employ bearings on a single side.

In certain embodiments, the launching wheels 108, 110 may be driven by the launching motors 122, 124 to counter rotate. When a ball is fed between the launching wheels 108, 110, it may be propelled at a relatively high velocity from the launching wheels 108, 118 away from the ball launching system.

In certain embodiments, the outer surfaces of the launching wheels 108, 110 may provide for a relative high friction surface to facilitate the acceleration of a ball to a high velocity during launch. The surface of the launching wheels 108, 110 may comprise a variety of materials including, for example and without limitation, one or more of natural rubber, polyurethane, silicon rubber, thermoplastic polyurethane ("TPU"), sand paper, textured plastic, metal, fabric, or the like, and/or any suitable combinations thereof. In some embodiments, the launching wheels may define one or more U and/or V-shaped grooves that may increase the grip and/or friction against the ball during launch. As a ball enters the wheels it may be forced into the U and/or V-shaped grove, enhancing the friction of the ball against the launching wheels 108, 110 and enabling a higher launch speed from the ball launching system.

In some embodiments, each launching wheel 108, 110 may comprise a plurality of wheels that together may define an approximate U and/or V-shaped groove. For example, in certain embodiments, a launching wheel 108, 110 may comprise two narrower wheels connected side-by-side that together, defined an approximate U and/or V-shaped groove. Although various embodiments described herein detail launching wheels 108, 110 that include surfaces that define one or more U and/or V-shaped grooves, it will be appreciated that a variety of other suitable wheel surface profiles may be employed in further embodiments.

In certain embodiments, such as embodiments employing brushless motors, the launching motors 122, 124 may allow for closed-loop speed control. For example, a control system included the ball launching system driving a brushless motor may evaluate the motor speed, either through an external sensor or based on the electro-motive force observed on the coils, and/or a measurement of the ball exit launch velocity, and may precisely regulate the motor speed with an appropriate control algorithms. Suitable control algorithms may include, for example and without limitation, one or more proportional control algorithms, proportional-integral control algorithms, and/or proportional-integral-derivative control algorithms. Consistent with embodiments disclosed herein, closed-loop control of the launching motors 122, 124 may allow for relatively repeatable and/or precise control of launching wheel velocity and, by extension, the ball launch velocity. In contrast, in a conventional brushed DC motor system, the wheel velocity may decrease as the battery voltage decreases.

In further embodiments, closed-loop control of the launching motors 122, 124 may also allowing for relatively quick progression of ball launches and/or shots having different characteristics. For example, if a sequence of shots is desired that have different spin and/or speed characteristics from shot to shot, closed-loop motor control (e.g., closed-loop motor control of brushless motors) may allow for actively breaking of the launching wheels 108, 110 by the launching motors 122, 124. This may facilitate, for example and without limitation, a fast shot followed shortly thereafter by a slow shot, a top spin shot followed shortly thereafter by a back spin shot, and/or the like.

In addition, the improved efficiency of brushless motors, coupled with other power efficiency approaches detailed herein, may allow for a relatively compact battery size. As illustrated, a relatively compact removable battery 134 may be used to power the ball launching system and/or its various constituent motors, sensors, control systems, and/or other mechanisms. In some embodiments, a lithium-ion and/or lithium polymer battery architecture may be employed in connection with the removable battery 134, which may provide for additional weight savings. For example, when compared a 10-pound lead acid battery, similar energy density and/or battery life may be achieved with an approximately 2-3-pound lithium-ion battery. Relatively light, smaller batteries may also allow for more user-friendly quick swap latching mechanisms for interfacing with the removable battery 134 to be employed.

Figure 4:
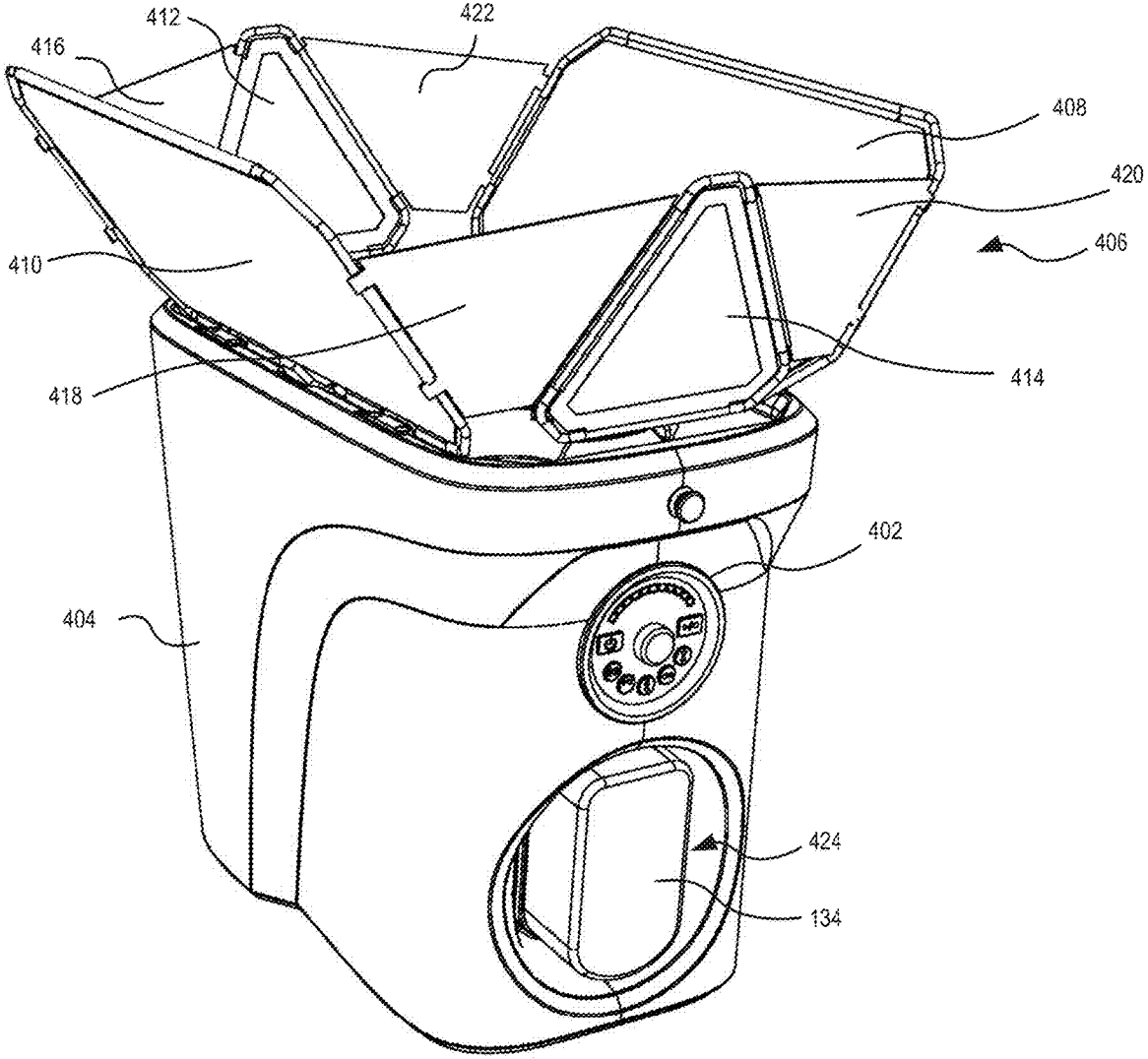
FIG. 4 illustrates an example of an exterior of a ball launching system including an expandable ball hopper, a control panel, and a removable battery consistent with certain embodiments of the present disclosure.

FIG. 4 illustrates an example of an exterior of a ball launching system including an expandable ball hopper 406, a control panel 402, and a removable battery 134 consistent with certain embodiments of the present disclosure. As illustrated, the ball launching system may comprise an external shell 404 configured to enclose various internal mechanisms of the ball launching system (e.g., internal mechanism 100 as illustrated in connection with FIG. 1). A variety of suitable materials may be used to form the external shell 404 including, for example and without limitation, plastic materials, sheet metal, and/or any suitable combination thereof.

The removable battery 134 may be configured to interface with the ball launching system via a recess 424 defined in the external shell 404. In certain embodiments, the interface may comprise electric contacts configured to interface with complementary contacts on the removable battery 134 and a mechanical mechanism configured to retain the removable battery 134 when interfaced with the ball launching system. In some embodiments, the mechanism may comprise a quick swap latching mechanism allowing for relatively easy exchange of the removable battery 134. Although not specifically illustrated, in some embodiments, the recess 424 may be covered with a battery door, which may provide for a more seamless appearance.

The control panel 402 may comprise a variety of suitable user input and/or status notification interfaces. For example, in various embodiments, the control panel 402 may comprise any suitable combination of buttons, knobs, touch panels, indicator lights, and/or the like, that may allow a user to, among other things, power on and off the ball launching machine, adjust and/or otherwise configure the machine and/or shot and/or launching parameters, determine machine status (e.g., battery charge status, wireless connectivity status with a mobile device and/or a network, etc.), access, load, configure, and/or initiate practice programs, and/or the like.

Various embodiments of the disclosed ball launching system may be relatively compact. A relatively compact machine, however, proves challenging in terms of achieving a relatively high ball capacity (e.g., 50 balls or more) if conventional hopper designs are used. Consistent with embodiments disclosed herein, expandable ball hopper designs may be used that may be selectively configured between a closed configuration for storage and/or transport and an open configuration with increased ball capacity during operation of ball launching system.

Figure 5:
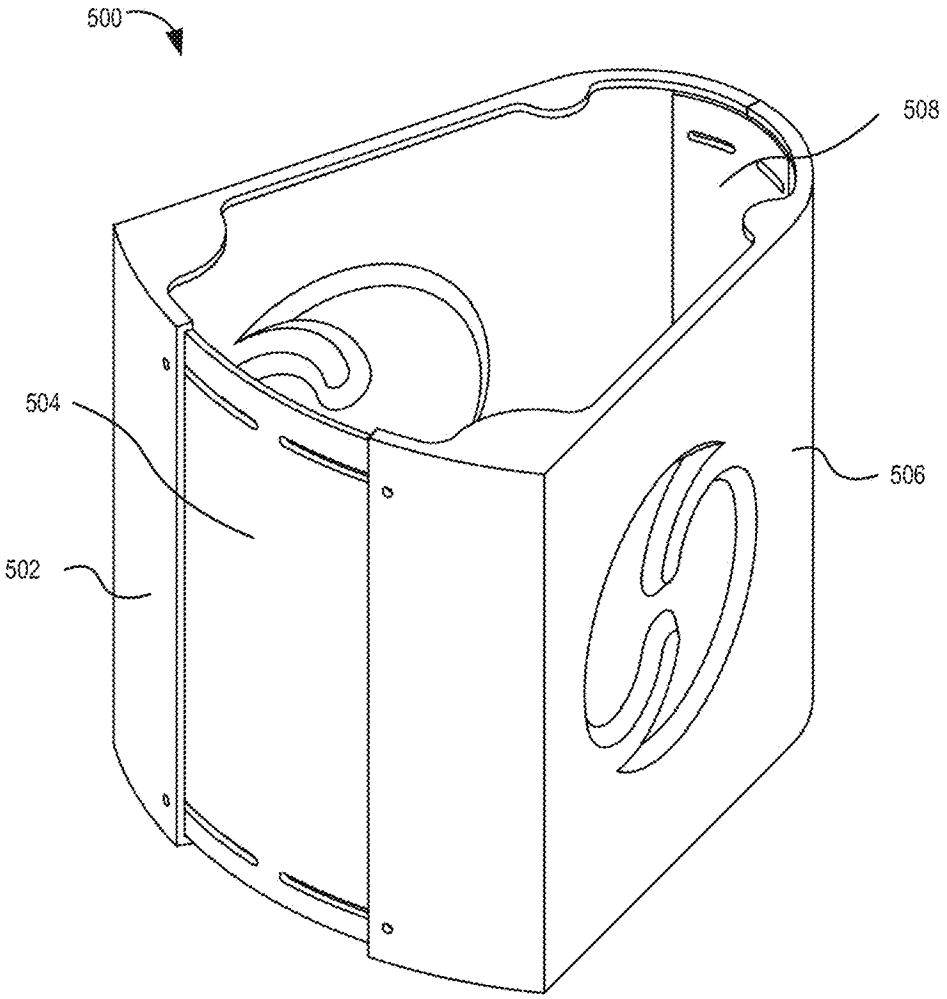
FIG. 5 shows an example of an expandable rigid shell that may be used as a ball hopper consistent with certain embodiments of the present disclosure.

FIG. 5 shows an example of an expandable rigid shell 500 that may be used as an expandable ball hopper consistent with certain embodiments of the present disclosure. In various embodiments, the expandable rigid shell 500 may be used as an external case for the ball launching system during storage and transport and be configured to surround the ball launching system and/or portions thereof. During operation, the expandable rigid shell 500 may be removed from the ball launching system and placed on top of the ball launching system for use as a hopper. A variety of suitable materials may be used to form the expandable rigid shell including, for example and without limitation, plastic materials.

In various embodiments, the expandable rigid shell 500 may be configured to expand laterally so as to increase its volume when used as a ball hopper. Although not specifically shown, in certain embodiments, the hopper may, alternatively or additionally, be configured to expand vertically. In some embodiments, the expandable rigid shell 500 may comprise side panels 502, 506 which may be configured to articulate relative to each other between an open and a closed hopper configuration. When the side panels 502, 506 are configured in an open configuration, a wall 504 connecting the panels 502, 506 may be exposed, thereby increasing the volume of the ball hopper. In some embodiments, the expandable rigid shell 500 may further be expanded to expose one or more other walls (e.g., wall 508) connecting the panels 502, 506. Although the side panels 502, 506 are shown as pivoting about a vertical access when opened, they may also pivot open about a horizontal axis and/or any other suitable angle to form a ball hopper with a wider mouth.

Referring back to FIG. 4, in some embodiments, the ball launching system comprise a number of foldable primary panels 408-414 used to form portions of an expandable ball hopper 406. As illustrated, the foldable primary panels 408-414 may be configured to fold up in an origami-style to be relatively compact when configured in a closed configuration, while forming portions of an expandable ball hopper 406 having a relatively large ball capacity when folded out past vertical in an open configuration (e.g., such that the ball hopper has a wider mouth relative to its bottom).

Conventional panel-based hopper designs typically have four panels on the top of the ball machine that fold open to a vertical orientation, like the lid of a cardboard box. For a ball machine of width w, these conventional panel designs may only create a ball hopper with walls of height w/2 and width w. In contrast, by using a folding origami-style expandable ball hopper 406 consistent with various embodiments disclosed herein, the hopper walls formed by foldable primary panels 408-414 may be expanded past vertical, creating a hopper geometry with a wider mouth and/or a relatively larger ball capacity and/or facilitating improved agitation of balls in the expandable ball hopper 406.

As illustrated, in some embodiments, the primary panels 408-414 may be connected by associated secondary panels 416-422 to form the outer walls of the expandable ball hopper 406. For example, primary panel 408 may be connected to primary panel 412 by secondary panel 422, primary panel 412 may be connected to primary panel 410 by secondary panel 416, primary panel 410 may be connected to primary panel 414 by secondary panel 418, and primary panel 414 may be connected to primary panel 408 by secondary panel 420. The shapes of the primary panels 408-414 and, by extension, secondary panels 416-422 may vary based on the application and/or geometry of a particular ball launching system. Although the embodiments illustrated in connection with FIG. 4 include opposing primary panels 408, 410 that are rectangular in shape and opposing primary panels 412, 414 that are triangular in shape with correspondingly shaped secondary panels 416-422, it will be appreciated that a variety of other suitable primary and secondary panel geometries may be employed in connection with the various disclosed embodiments.

In some embodiments, the primary panels 408-414 may be relatively rigid. For example, in certain embodiments, the primary panels 408-414 may comprise a wire and/or plastic rigid outer frame with a less rigid material providing an inner face of the panel. In further embodiments, the primary panels 408-414 may be fully rigid. For example, the primary panels 408-414 may, in some embodiments, comprise plastic and/or metal plates and/or panels.

The secondary panels 416-422 may, in certain embodiments, be less rigid than the primary panels 408-414 to help facilitate folding of the primary panels 408-414 between open and closed configurations. In some embodiments, the secondary panels 408-422 may comprise a fabric, a flexible plastic material, and/or any other suitable type of material. It will be appreciated that a variety of materials and/or construction types may be used in connection with the primary panels 408-414 and the secondary panels 416-422, and that any suitable materials, construction types, and/or combinations thereof may be used in connection with the disclosed embodiments.

To fold the expandable hopper 406 into a closed configuration, a user may first close primary panel 408, subsequently close primary panels 412, 414, and finally close primary panel 410, resulting in a closed hopper, although other suitable folding procedures are also contemplated. The primary panels 408-414 and secondary panels 416-422 may be connected using a variety of suitable methods and/or mechanisms to allow for pivoting and/or articulation along their interconnected sides. For example and without limitation, the primary panels 408-414 and secondary panels 416-422 may be connected along their interconnected sides using metal, plastic, and/or fabric hinges.

Figure 6:
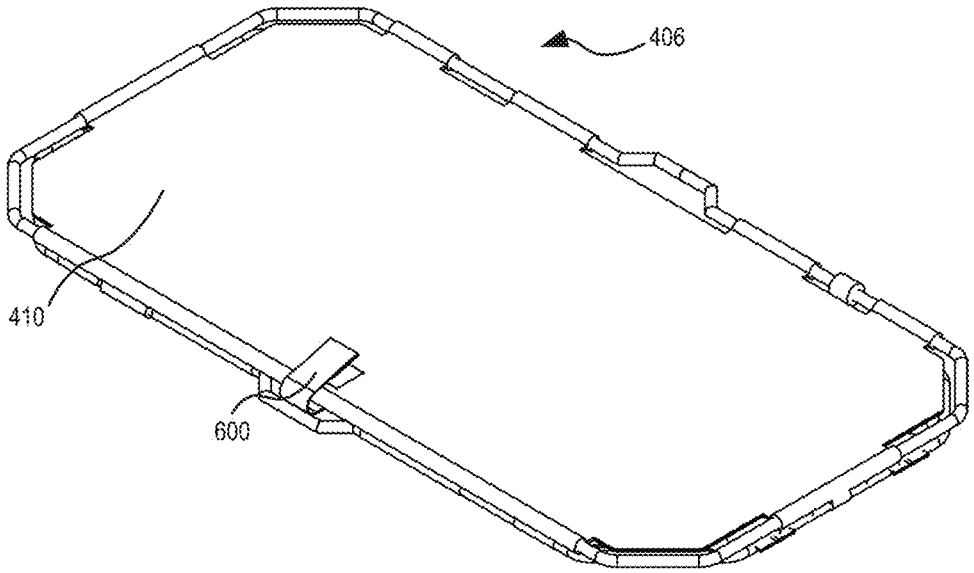
FIG. 6 shows an example of an expandable hopper in a closed configuration consistent with certain embodiments of the present disclosure.

FIG. 6 shows an example of an expandable hopper 406 in a closed configuration consistent with certain embodiments of the present disclosure. As shown, in some embodiments, a tab 600 may be included on at least one of the panels that may be used to keep the expandable hopper 406 in a closed configuration during storage and/or transport. In some embodiments, the tab 600 may comprise a clip mechanism, a hook-and-loop closure mechanism, a magnetic closure mechanism, and/or any other suitable mechanism to secure the expandable hopper 406 in a closed configuration.

Figure 7:
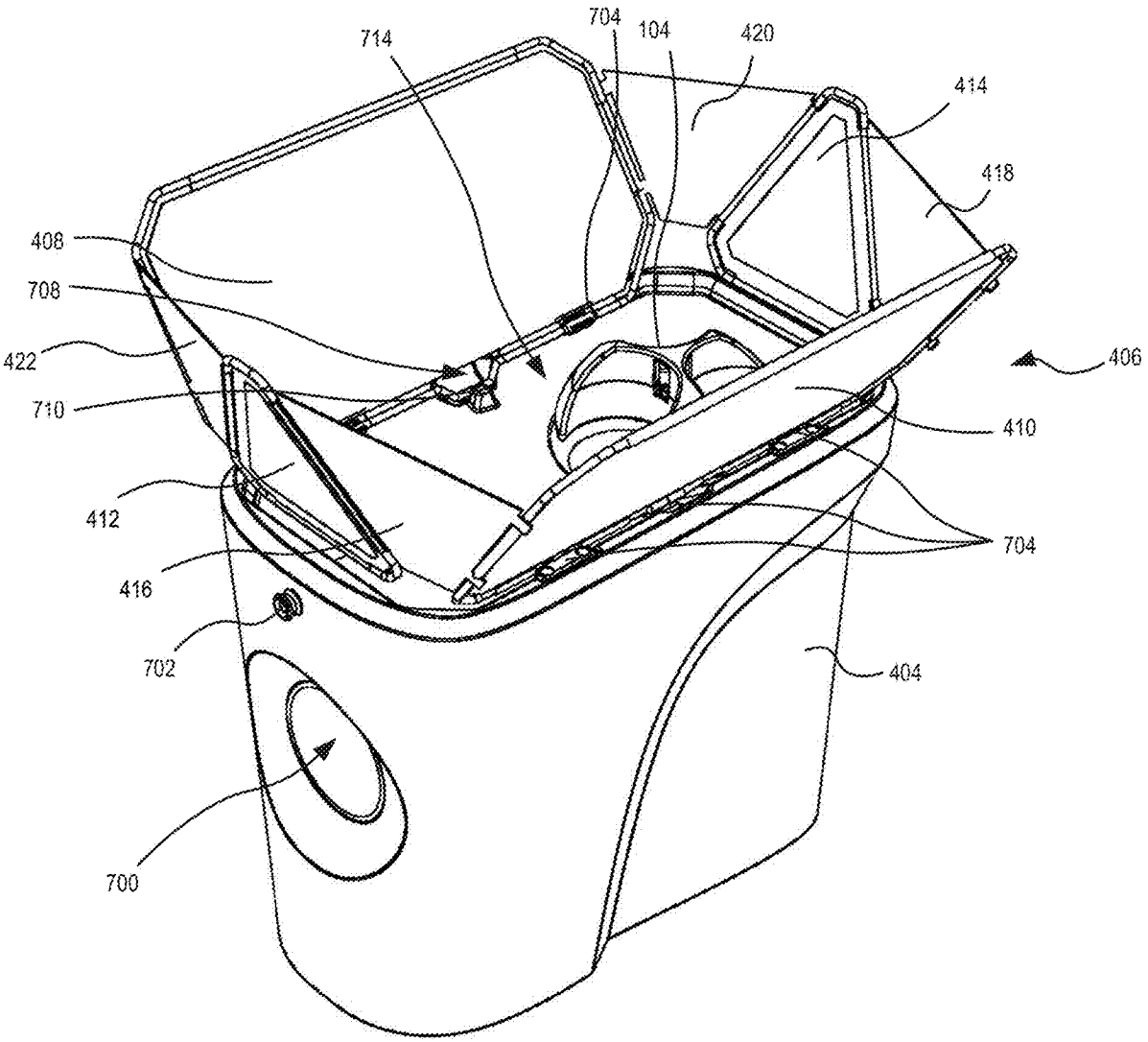
FIG. 7 illustrates an exterior view of a ball launching system including an expandable ball hopper in an open configuration, an exit port, and an indicator light consistent with certain embodiments of the present disclosure.

As can be more readily seen in FIG. 7, which illustrates an exterior view of a ball launching system including an expandable ball hopper 406 in an open configuration as well as an exit port 700, and an ball launching indicator light 702, the primary panels 408-414 and secondary panels 416-422 may connect to the frame and/or the exterior shell 404 of the ball launching system via one or more pivoting and/or hinged connections 704, allowing for articulation of the panels 408-422 relative to the sides of the system.

In some embodiments, one or more pivoting and/or hinged connections may comprise plastic hinges. In certain embodiments, the exterior shell 404 may integrally form and/or be connected to a separate a partial hinge cylinder that may allow a portion of the frame of the primary panels 408-414 to snap into place within the partial hinge cylinder, allowing the primary panels 408-414 and secondary panels 416-422 to articulate and/or otherwise pivot about the hinge. It will be appreciated that a variety of mechanisms and/or combinations of mechanisms may be used to implement the pivoting and/or hinged connections 704, and that any suitable type of hinged connection and/or combinations thereof may be used in connection with the disclosed embodiments, including for example and without limitation, metal hinge connections.

In various embodiments, the primary panels 408-414 (and/or secondary panels 416-422) may latch into place when in an open configuration so that they do not move substantially during operation of the ball launching system. A variety of suitable mechanisms may be used to latch the primary panels 408-414 and/or secondary panels 416-422 in place including, for example and without limitation, hook-and-loop mechanisms, magnets, and/or mechanical structures. For example, as illustrated in FIG. 7, a primary panel 408 may comprise a tab portion 708 that may protrude from the main panel body. The tab portion 708 may be configured to interface with a detent mechanism 710, which may be integral to the exterior shell 404 and/or be a separate mechanism connected to the shell 404. The tab portion 708 of the primary panel 408 may be mechanically secured within the detent mechanism 710 when the primary panel 708 is articulated to an open position. Other primary panels 410-414 may be associated with the same and/or similar structures.

Referring back to FIG. 1, the ball launching system may further comprise a rotating carousel 104. The carousel 104 may be configured to agitate balls included in the expandable ball hopper and position the balls such that they drop into a pre-launch chamber 106 of a ball dispensing mechanism. The carousel 104 may be driven by a motor 132. Motor 132 may comprise, for example and without limitation, a stepper motor, a servo motor, a DC motor, and/or any other suitable type of motor. In certain embodiments, a gear reduction mechanism may be used to reduce speed of the driven carousel 104 and increase torque.

Certain motor drivers, such as, for example and without limitation, a DRV8801 from Texas Instruments®, may include current sensing capabilities. If the motor 132 stalls (e.g., due to a ball jammed in the ball dispensing mechanism), the back-EMF may decrease, and the current may increase, indicating a ball jam condition. Under such conditions, the carousel motor 132 may reverse direction.

In some embodiments, the ball launching system may further comprise one or more sensors disposed proximate to the carousel 104 and/or associated components to detect ball jams. For example, as can be more readily seen in FIG. 10, which illustrates various details of an example of a ball dispensing mechanism consistent with certain embodiments of the present disclosure and is described in more detail below, a strain gauge may be attached to a dispense shaft 1006 configured to drive the carousel 104 (which may in certain embodiments be a shared shaft between dispense gate 136 and the carousel 104). The strain gauge may be used to measure the torque on the shaft 1006, thereby identifying an overload condition associated with a ball jam condition. In some embodiments, a low resolution high frame rate camera, such as those commonly used for tracking in computer mice, can be used to monitor the surface of dispense shaft 1006 and/or carousel 104 and measure the angular velocity of dispense shaft 1006 and/or carousel 104, detecting aberrations from expected angular velocity associated with a ball jam condition.

In further embodiments, reflecting tape and an optical emitter and/or detector may be used to track rotation of the dispense shaft 1006 and/or carousel 104, which may be used to identify possible ball jam conditions. In additional embodiments, magnets may be placed on carousel 104 and/or dispense shaft 1006 that may be used in conjunction with a magnetic sensor such as a Hall-effect sensor to measure the rotation rate of the carousel 104, detecting aberrant conditions associated with a ball jams. In yet further embodiments, encoders such as, for example and without limitation, capacitive and/or optical encoders may be directly attached to dispense shaft 1006 to ensure rotation is occurring within expected parameters. It will be appreciated that a wide variety of sensors and/or associated methods may be used to detect ball jam conditions, and that any suitable type of sensor and/or combination of sensors, including any of the sensors described herein, may be used to detect ball jams consistent with various disclosed embodiments.

In certain embodiments, using sensors to detect ball jams may reduce the dependence on springs and/or plates for ball jam prevention, allowing for a more compact ball launching system. Use of a carousel 104 that may allow for rotation in both directions (e.g., reversing direction when a ball jam condition is detected) may also provide for improved ball agitation and reduction in the occurrence of ball misfires and jamming.

Figure 8:
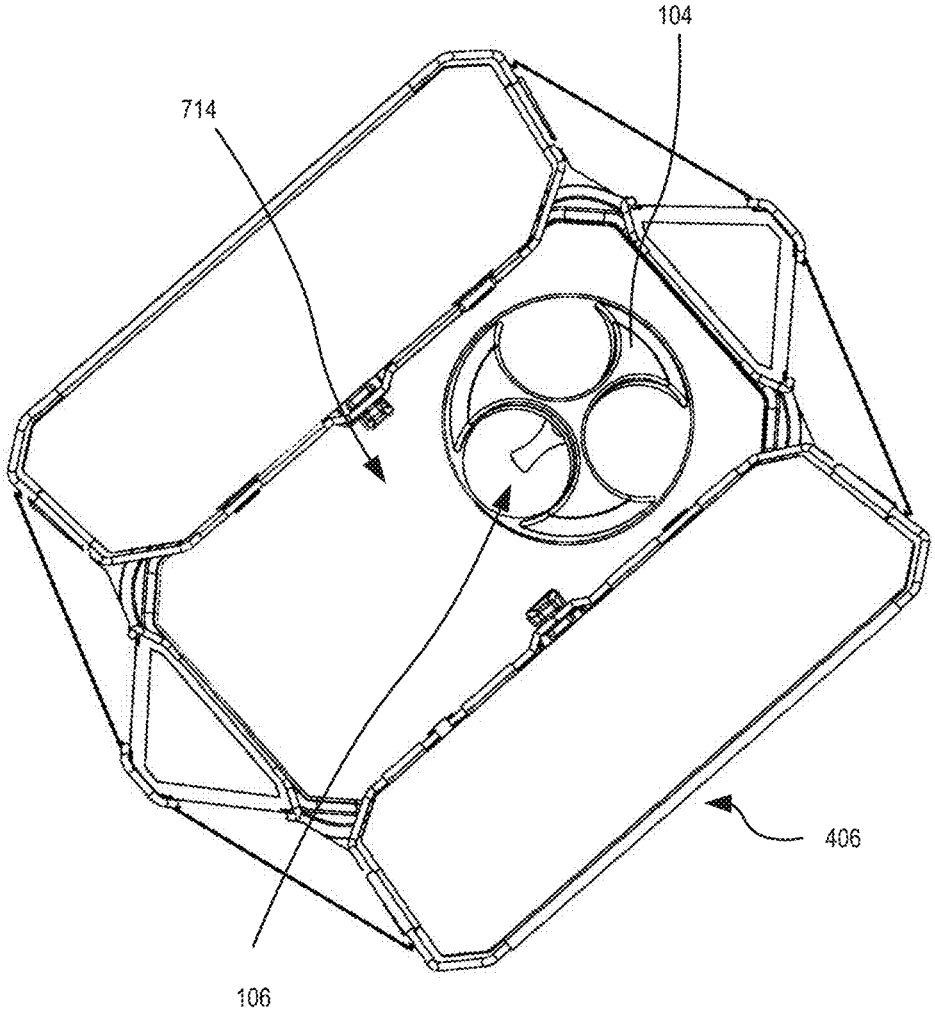
FIG. 8 illustrates a top exterior view of a ball launching system showing a ball carousel and a pre-launch chamber consistent with certain embodiments of the present disclosure.

As can be seen in FIG. 7, as described in part above, and FIG. 8, which illustrates a top exterior view of a ball launching system showing the ball carousel 104 and the pre-launch chamber 106 consistent with certain embodiments of the present disclosure, a top portion of the exterior shell of the ball launching system may define a bottom of the expandable ball hopper 406. In certain embodiments, at least a portion of the bottom of the expandable ball hopper 406 defined by the top part of the exterior shell may comprise a slopped portion 714 (although in some embodiments the entirety of the bottom of the expandable ball hopper 406 may be sloped). In certain embodiments, the sloped portion 714 may slope downwards towards the rotating carousel 104. The sloped portion 714 of the bottom of the expandable ball hopper 406 may help facilitate the movement of balls disposed in the hopper downwards towards the rotating carousel 104 and the pre-launch chamber 106. In embodiments, the slop of the bottom of the hopper may be enhanced when the ball system is titled by the altitude adjustment mechanism.

As discussed above, the carousel 104 may be configured to rotate and agitate balls included in the expandable ball hopper 406 and position the balls such that they drop into the pre-launch chamber 106 of a ball dispensing mechanism. A taller carousel design may, in some circumstances, be more effective at agitating balls included in the expandable ball hopper 406, but may be associated in an overall taller height of the ball launching system. To allow for improved ball agitation while facilitating a carousel design that may be reduced in height for storage and/or transport, certain embodiments disclosed herein may use a multi-piece carousel design that may be switched between an operational configuration and a storage configuration. Further embodiments may employ a taller single-piece carousel that may be removable allowing for storage (e.g., separate external storage and/or in another location on the ball launching system).

Figure 9A:
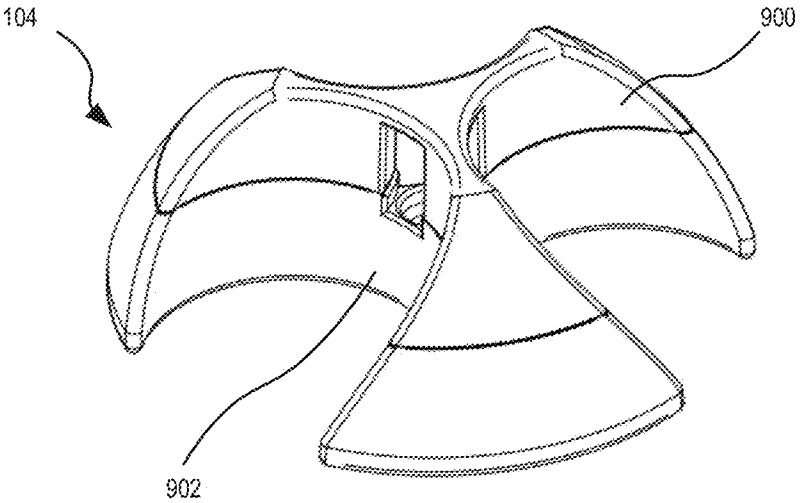
FIG. 9A illustrates an example of a multi-piece carousel in an operational configuration consistent with certain embodiments of the present disclosure.
Figure 9B:
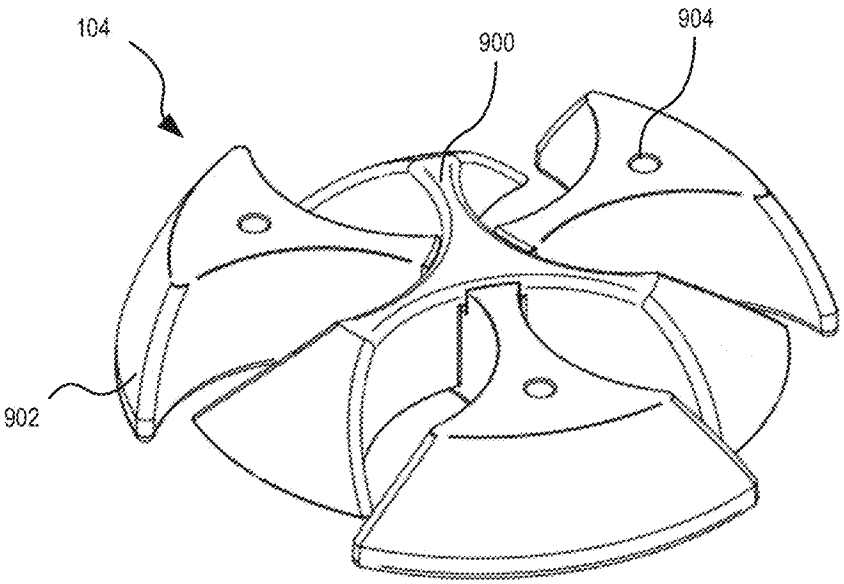
FIG. 9B illustrates an example of a multi-piece carousel in a storage configuration consistent with certain embodiments of the present disclosure.

FIG. 9A illustrates an example of a multi-piece carousel 104 in an operational configuration consistent with certain embodiments of the present disclosure. FIG. 9B illustrates an example of a multi-piece carousel 104 in a storage configuration consistent with certain embodiments of the present disclosure. In some embodiments, the carousel 104 may comprise a top piece 900 and a bottom piece 902. In an operational configuration, the top piece 900 may be secured on top of the bottom piece 902 to form an assembled carousel 104. The top piece 900 and the bottom piece 902 may be held together when in an operational configuration by a variety suitable mechanisms of including, for example and without limitation, spring compression mechanisms. As can be more readily seen in FIG. 9B, one or more structures may be defined in the top of the bottom piece 902 (e.g., indentations 804) that interface with one or more complimentary structures defined in the bottom of the top piece 900 (not shown) to facilitate alignment of the top piece 900 relative to the bottom piece 902 when in an operational configuration.

In a storage configuration, the top piece 900 of the carousel 104 may nest with the bottom piece 902 of the carousel 902, as shown in FIG. 9B. For example, in some embodiments, the top piece 900 may be lifted relative to the bottom piece 902 (e.g., lifted against the compressive force of a spring compression mechanism securing the top piece 900 against the bottom piece 902 when in an operational configuration), rotated, and then dropped into a nesting configuration with the bottom piece 902 facilitated by complementary structures of the top piece 900 and the bottom piece 902 (e.g., nesting channels, grooves, and/or the like). In this manner, the overall height of the carousel 104 may be reduced for storage and/or transport, while still allowing for a relatively tall carousel 104 for improved ball agitation during operation. It will be appreciated that a wide variety of other multi-piece carousel 104 designs may be employed consistent with the disclosed embodiments including, for example and without limitation, designs where a top portion of the carousel screws into a bottom portion, and/or the like.

As can more readily been seen in FIG. 1, FIG. 7, and FIG. 8, the carousel 104 may be configured to rotate and agitate balls included in the expandable ball hopper 406 and position the balls such that they drop into a pre-launch chamber 106 of a ball dispensing mechanism. A ball loaded within the pre-launch chamber 106 may be stopped by a dispense gate 136. In some embodiments, the dispense gate 136 may be actuated by the same motor 134 as the rotating carousel 104. For example, in some embodiments, the dispense gate 136 may share a shaft with the carousel 104 that is actuated by the motor 134. In further embodiments, the dispense gate 136 may be actuated by a separate motor, solenoid, and/or other suitable mechanism.

Figure 10:
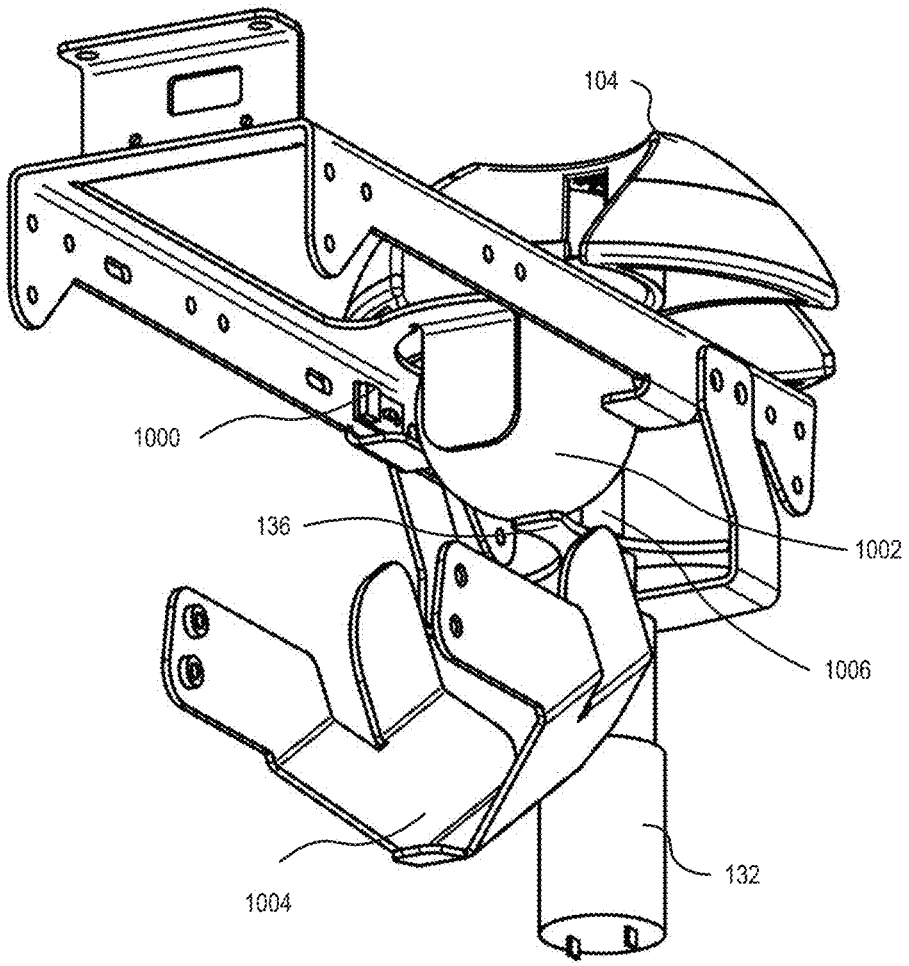
FIG. 10 illustrates an example of a ball dispensing mechanism consistent with certain embodiments of the present disclosure.

FIG. 10 illustrates details of an example of a ball dispensing mechanism consistent with certain embodiments of the present disclosure. As illustrated, the carousel 104 may rotate until a ball 1002 is agitated and drops into the pre-launch chamber. After dropping into the pre-launch chamber, the ball 1002 and is stopped by the dispense gate 136. In certain embodiments, a ball detection sensor 1000 (or a plurality of sensors) may be configured to determine whether a ball is loaded within the pre-launch chamber. When a ball is detected by ball detection sensor 1000, one or more controllers associated with motor 132 may stop rotation of the motor and/or carousel 134. This may, among other things, help to conserve power. If a ball does not load into the pre-launch chamber at first opportunity (e.g., as indicated by sensor 1000), the motor 132 and/or carousel 104 may continue to rotate, hunting for another ball, which often may be found before a user notices a delay.

The ball detection sensor 1000 may comprise a variety of types of suitable sensors and/or combination of sensors. For example and without limitation, the ball detection sensor 1000 may comprise an optical sensor detecting reflections and/or interruptions in a beam of light caused by a ball 1002 being present in the pre-launch chamber, an ultrasonic sensor, a force-based sensor such as a strain gauge, a relay switch, and/or any other suitable type of sensor.

When a ball is ready to be launched from the ball launching system, the dispense gate 136 may be actuated (e.g., actuated by motor 134 and/or another associated actuation mechanism), allowing the ball 1002 to enter a dispensing channel 1004 of the ball dispensing mechanism and fed into the rotating launching wheels of the ball launching system. In some embodiments, the dispense gate 136 may be actuated based on a customized practice program, a set interval after detecting the ball within the pre-launch chamber, based on a received user command, and/or the like. In some embodiments, this interval may very from shot to shot for a more realistic practice session.

Using a pre-launch chamber with ball detection capabilities consistent with various embodiments disclosed herein may enable a variety of functions. In some embodiments, as described above, a pre-launch chamber with ball detection capabilities may conserve power and/or aid in recovering from carousel 104 loading issues. The pre-launch chamber and associated ball detection capabilities may further enable a ball 1002 to be queued up in the pre-load chamber for launch.

For example, a queued-up ball 1002 within the pre-launch chamber may enable a "coach mode" functionality of the ball launching system. In "coach mode," a partner and/or user may signal the ball launching system to launch shots on demand using a remote control that, in some embodiments, may comprise a mobile device configured to wirelessly communicate with the ball launching system, as described in more detail below. A partner and/or user may choose parameters for a next shot and/or accept default parameters, and when the partner and/or user is ready for the queued ball 1002 to be launched, they may provide with the mobile device and/or ball launching system with an associated indication. The queued ball 1002 in the pre-launch chamber may then be launched either immediately or after some predetermined duration. Detecting balls within the pre-launch chamber consistent with embodiments described herein may also enable the ball launching system to shut off and/or go into a standby mode when all balls are dispensed, further conserving power.

In some embodiments, detecting a queued ball 1002 within the pre-launch chamber may allow the ball launching system to provide a user an indication as to when a ball will be launched from the ball launching system. Conventional ball machines may generally not provide an indication as to when a ball will be launched, so it may come to a surprise to a user when a ball is launched (or not launched). As shown in FIG. 7, certain embodiments of the disclosed ball launching system may comprise a ball launching indicator light 702. In some embodiments, the ball launching indicator light 702 may comprise a LED light, although other indicators may also be used including, for example and without limitation, audio indicators.

In some embodiments, detecting a queued ball 1002 in the pre-launch chamber may further allow the ball launching system to identify when the ball hopper 406 is empty. If a ball is not loaded into the pre-launch chamber for an extended interval and/or time period, the ball launching system may turn itself off and/or enter a standby mode to conserve power while previously dispensed balls are collected by a user.

The ball launching indicator light 702 may, in some embodiments, blink and/or otherwise be lighted to indicate when a ball is about to be launched from exit port 700 of the ball launching system. In certain embodiments, the ball launching indicator light 702 may pulse slowly if the ball launching system is powered but not spinning, pulse faster when the launching wheels are spilling, and pulse even more rapidly shortly before a ball is to be launched from the exit port 700 of the ball launching system. It will be appreciated that a variety of other indication patterns (including audio indication patterns) may also be used in connection with communicating various ball launching system status information (e.g., operational conditions, fault and/or error conditions, and/or the like) to a user consistent with various aspects of the disclosed embodiments. For example, in some embodiments, multiple indicator lights (e.g., LEDs of different colors) and/or different audio tones may be used to indicate various ball launching system status information to a user. This may, among other things, allow a user to prepare for an incoming shot and/or provide an indication that the ball hopper 406 is empty.

Figure 11:
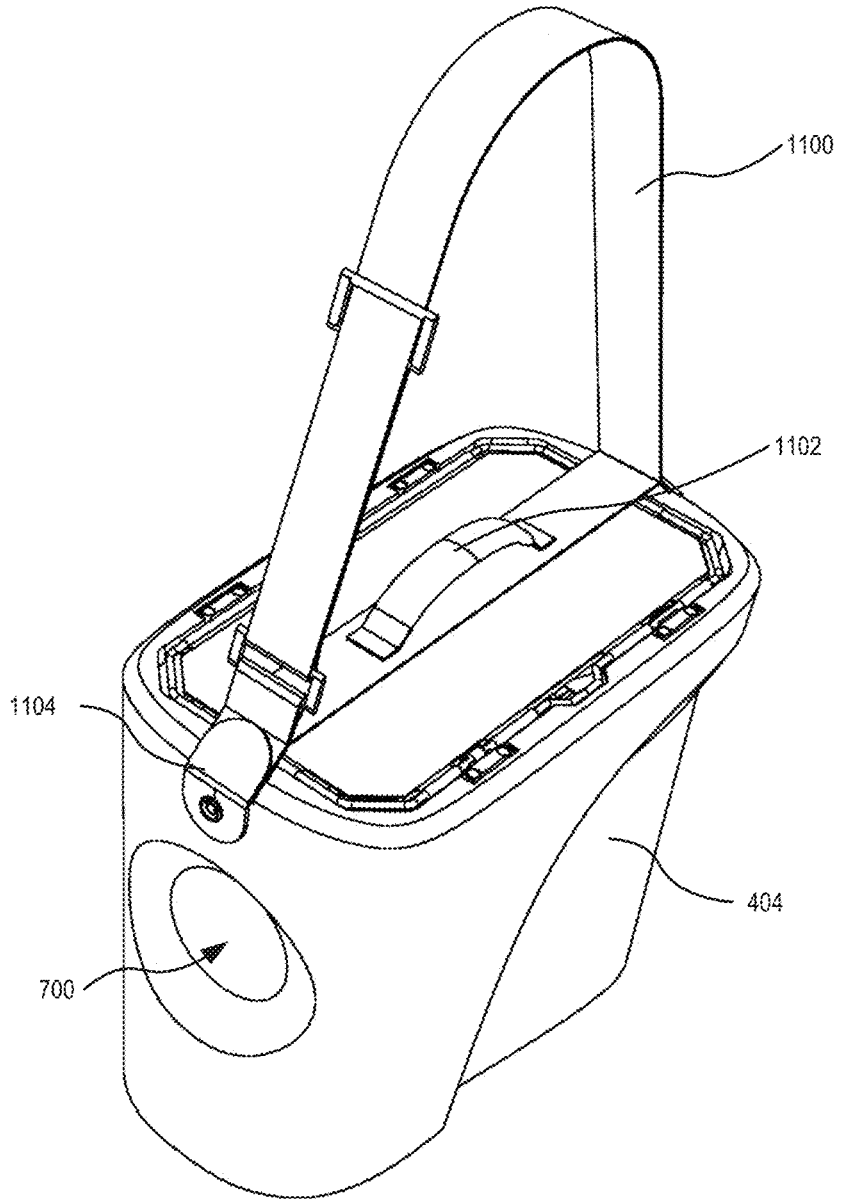
FIG. 11 illustrates an example of a removable carrying strap consistent with certain embodiments of the present disclosure.

FIG. 11 illustrates an example of a carrying strap 1100 consistent with certain embodiments of the present disclosure. In some embodiments, the carrying strap 1100 may be removable from the ball launching system. For example, one or more mountain posts 1104, clips, rings, and/or the like may be integrally formed by and/or attached to the exterior shell 404 and may interface with complementary structures on the carrying strap 1100 to secure the carrying strap 1100 to the ball launching system for transport. In some embodiments, a handle 1102 may further be used to carry the ball launching system. The handle 1102 may be separate from the carrying strap or, as illustrated, sewn into and/or otherwise formed by the carrying strap 1100.

In certain embodiments, the carrying strap 1100 may block the exit port 700 of the ball launching machine when installed. If carrying strap 1100 also prevents the ball hopper from opening, the user may be forced to remove it before using the ball launching system, which may provide a measure of safety. For example, as shown, the carrying strap 1100 may also function to retain the expandable ball hopper panels while in a closed configuration for storage and/or transport. Once the carrying strap 1100 has been removed, the expandable ball hopper panels may be articulated and reconfigured into an open configuration for operation.

It will be appreciated that a number of variations can be made to the architecture, relationships, and examples presented in connection with FIGS. 1-11 within the scope of the inventive body of work. For example, certain components and/or functionalities described above may be integrated into a single component and/or any suitable combination of components, systems, and/or services in any suitable configuration. Thus, it will be appreciated that the architecture, relationships, and examples presented in connection with FIGS. 1-11 are provided for purposes of illustration and explanation, and not limitation.

Consistent with certain embodiments disclosed herein, the operation of the ball launching system may be controlled and/or otherwise configured using, at least in part, a mobile device communicatively connected to the ball launching system. In various embodiments, the mobile device may be wirelessly connected using any suitable wireless communication protocol and/or associated wireless communication hardware. In further embodiments, the mobile device may be connected via a suitable wired connection.

The mobile device may comprise a variety of computing devices and/or systems, including any computing system or systems suitable to implement the systems and methods disclosed herein. In various embodiments the mobile device may comprise a smartphone configured to execute an application associated with the ball launching system. Although various non-limiting examples are described herein in connection with a smartphone mobile device, it will be appreciated that other types of mobile devices may also be used including, for example and without limitation, one or more laptop computer systems, tablet computers, smartwatches and/or other wearable mobile devices, and/or the like.

The mobile device may be configured to control and/or configure a variety of ball launching system operations and/or provide a user with a variety of information relating to such operations via an associated interface. For example, the mobile device may be configured to control the azimuth and/or altitude position of shots, control ball speed and/or spin (e.g., no spin, top spin, bottom spin), the timing and/or intervals between shots, select, configure, and/or load one or more practice programs for autonomous and/or semi-autonomous execution by the ball launching system, enable a user and/or partner to launch balls loaded into a pre-launch chamber on command (e.g., in a "coach mode" as described above), and/or provide a user with various status information relating the ball launching system (e.g., battery charge status, fault and/or error status, ball launch status, wireless connectivity status with a mobile device and/or a network, etc.) and/or the like.

In some embodiments, the mobile device may keep track of historical data including, for example and without limitation, number of shots fired, average speed, days practices, practice times/durations, and/or the like. In some embodiments, this data may be stored remotely in the cloud to ensure it is not lost, to enable friendly competition between players, and/or to facilitate advanced coaching analysis. In some embodiments, a cloud interface may also enable other players and/or coaches to share practice routines. In some instances, such practice routines may be shared in conjunction with video lessons.

Figure 12:
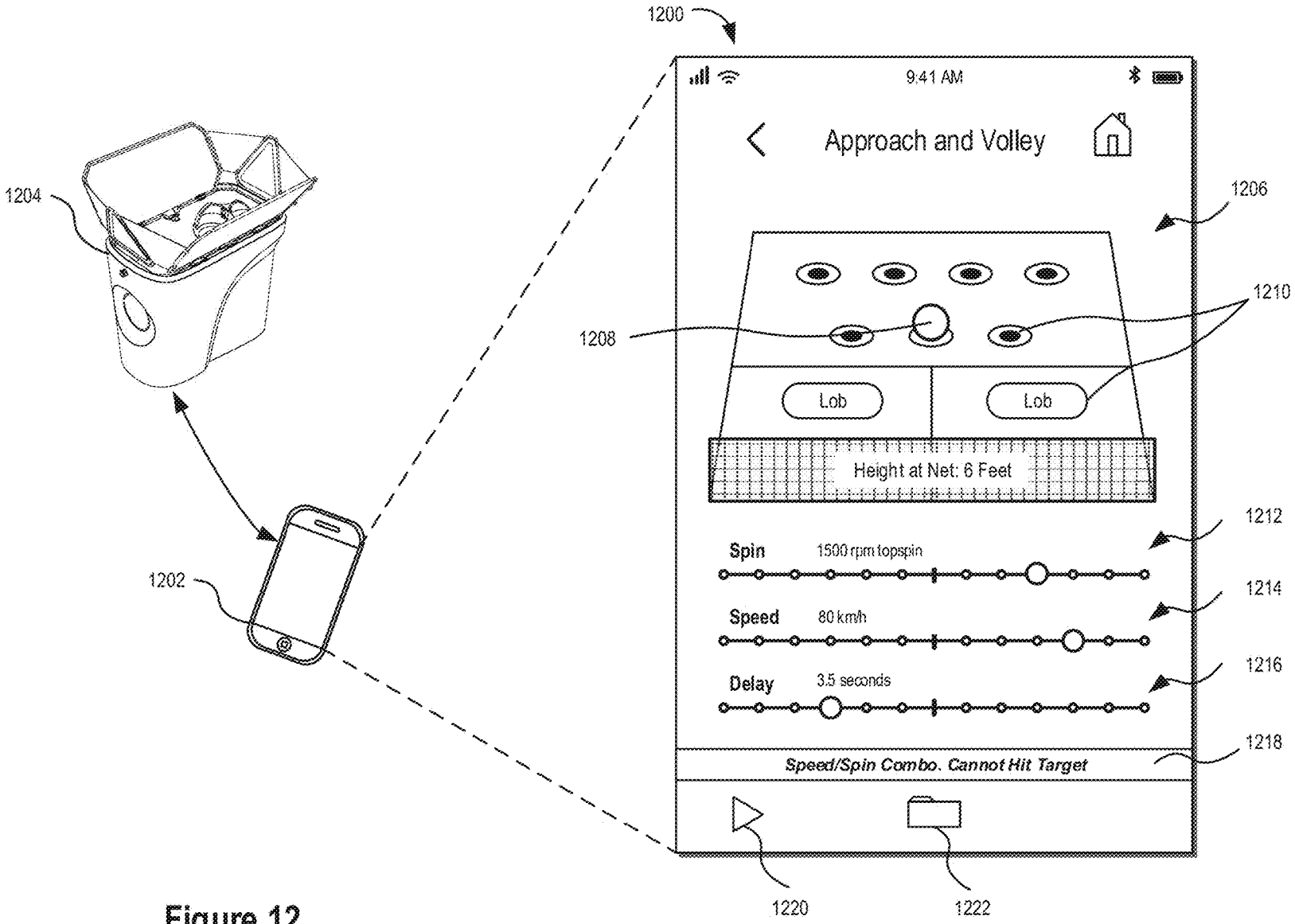
FIG. 12 illustrates an example of an interface for configuring shot parameters consistent with certain embodiments of the present disclosure.

FIG. 12 illustrates an example of an interface 1200 for configuring shot parameters of a ball launching system 1204 consistent with certain embodiments of the present disclosure. In some embodiments, the interface 1200 may be an interface of an application associated with a ball launching system 1204 in communication with a mobile device 1202 executing the application. A user may interact with the interface 1200 in a variety of ways including, for example and without limitation, via a touch screen of the mobile device 1202.

In some embodiments, the interface 1200 may comprise a visual representation of a playing court 1206. The playing court 1206 may comprise a region where the ball launching system 1204 may be capable of landing shots. For example, as illustrated, the playing court 1206 may be associated with an opposing side of a tennis court. In some embodiments, a user may adjust certain parameters associated with the playing court 1206 depending on an associated training application.

Via the interface 1200, a user may select a shot location 1208 within the playing court 1206 where they would like a shot from the ball launching system 1204 to land. For example, a user may touch a touchscreen interface of the mobile device 1202 at the shot location 1208 within the depiction of the playing court 1206 to indicate where they would like a shot from the ball launching system 1204 to land. In various embodiments, the interface 1200 may further provide information about the shot such as, for example, a height at which the shot will clear (or not clear) the net.

In certain embodiments, one or more predefined shot locations 1210 and/or shot types (e.g., lob shots) may be defined within the playing court 1206 and a user may select from the one or more predefined shot locations 1210 to identify a location 1208 where they would like a shot from the ball launching system 1204 to land. In addition and/or alternatively, a user may be able to select any location within the bounds of the play court 1206.

A user may select via one or more parameter control interfaces 1212-1216 associated with a shot from the ball launching system 1204. For example, a user may be able to adjust a ball spin (e.g., no spin, amount of top spin, amount of back spin) via a spin control interface 1212, adjust a launch speed via a speed control interface 1214, adjust a delay between a prior shot and the configured shot and/or after manually initiating a shot via a delay control interface 1216, and/or the like. As illustrated, parameter control interfaces 1212-1216 may comprise one or more slider interfaces that, in some embodiments, may comprise one or more pre-set values, although other types and/or combinations of control interfaces may also be used including, for example and without limitation, scrolling numbers, buttons with pre-set values, text entry fields, and/or the like.

In some embodiments, a user may specify a range of shot parameters via parameter control interfaces 1212-1216. For example, when a desired location 1208 has been selected, a user may define a range of desired shot parameters (e.g., a desired speed range, a desired spin rate range, and/or the like).

In some embodiments, once a desired location 1208 and/or one or more parameters have been selected (e.g., spin), there may be a limited range of other parameters that may result in valid and/or otherwise achievable shots. To provide a user an indication of permissible parameter ranges once a location 1208 and/or another parameter is selected, one or more of the parameter control interfaces 1212-1216 (and/or the playing court 1206) may provide an indication as to permissible ranges resulting in valid shots. For example, once a desired shot location 1208 and spin have been indicated, portions of the speed control interface 1214 may be highlighted to show a range of permissible speeds that may result in a valid and/or achievable shot. In further embodiments, valid parameters may be indicated by illustrating maximum and/or parameter values, sliders and/or scrolling numbers that present allowable values, a fixed menu of values with highlighted valid and/or disabled values, and/or the like. In some embodiments, such indications of limited valid parameter and/or location selections may occur in real time as a user changes location and/or parameter (e.g., spin) selections. The interface 1200 may further display an indication 1218 regarding whether a shot location 1208 and/or parameter combination is valid and/or otherwise achievable by the system 1204.

In various embodiments, valid and/or otherwise achievable shot location and/or parameter combinations may be determined based on a shot parameter analytics and/or control module executing on the mobile device 1202. For example, based on capabilities of the ball launching system 1204, the shot parameter analytics and/or control module may determine whether indicated desired shot locations and/or parameters are within the capabilities of the system 1204 (e.g., by determining a calculation of a ball flight for a proposed combination of parameters and/or the like). In some embodiments, such a determination may be performed analytically, using equations defining the motion of a spinning ball. In further embodiments, such a determination may be performed empirically using, for example, a set of pre-measured shots and/or interpolation if other values are to be used. It will be appreciated that any suitable method and/or combination of methods may be used to determine whether a desired shot location 1208 and/or associated parameters are within the capabilities of the ball launching system 1204 via associated ball flight calculations and/or determinations. In further embodiments, shot parameter analytics determinations may be performed by a remote cloud-based service in communication with the mobile device 1202.

A variety of information relating to a desired shot may be indicated on the interface 1200. For example, as illustrated, an indication of an estimated ball height over the net following launch may be indicated. Other useful information (e.g., estimated ball speed when launched, estimated ball speed when reaching shot location, and/or the like) may also be provided to a user via interface 1200.

The shot parameter analytics and/or control module may further generate associated control instructions to effectuate a desired shot indicated by a user. When a particular shot is executed (e.g., based on direct control by the user and/or as part of the initiation of a practice program), the control instructions may be communicated from the mobile device 1202 to the ball launching system 1204 for execution. In some embodiments, the control instructions may comprise, for example and without limitation, instructions relating to launching wheel top and bottom motor control speeds, azimuth motor control, altitude motor control, dispense gate actuation control (which may also actuate the carousel motor), and/or the like. Although various embodiments herein describe control instructions being generated by a module executing on the mobile device 1202 that are a transmitted to the ball launching system 1204, in further embodiments the control instructions may be generated by a control system of the ball launching system 1204 based on shot location and/or parameter information received by the mobile device and/or by a remote cloud-based service in communication with the mobile device 1202 and/or the ball launching system 1204.

The interface 1200 may comprise a variety of other user controls. For example and without limitation, the interface 1200 may comprise a launch button 1220 configured to signal the ball launching system 1404 to initiate an indicated shot (e.g., upon pressing the launch button 1220 and/or after a period of time following pressing the launch button). A user may further use a save button 1222 to save a desired shot for future use, use in a sequence of shots included in a practice program, and/or the like.

Figure 13:
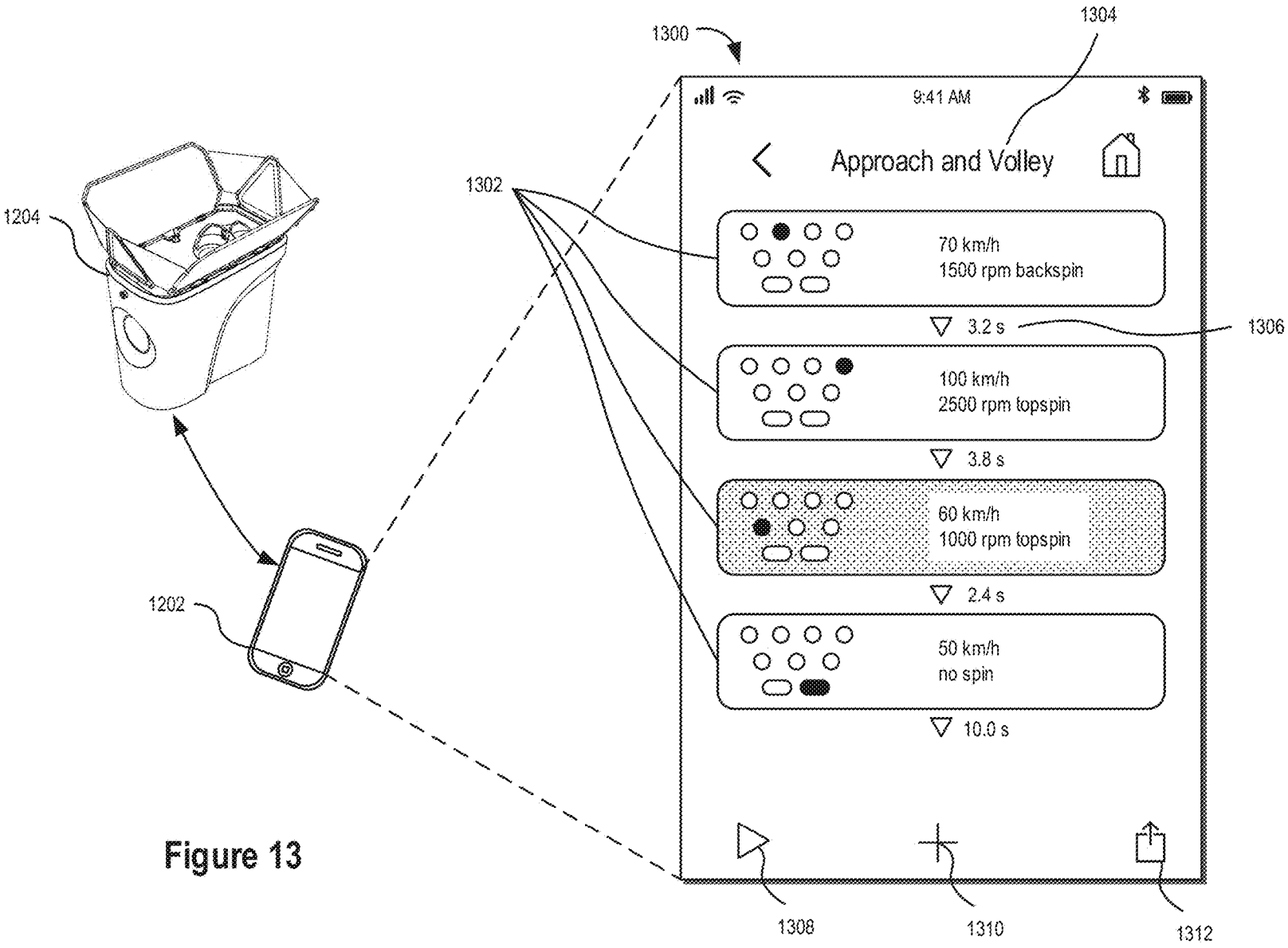
FIG. 13 illustrates an example of an interface showing saved shot parameters consistent with certain embodiments of the present disclosure.

As described above, in various embodiments, a user may program a sequence of desired shots for inclusion in a practice program and/or routine. FIG. 13 illustrates an example of an interface 1300 showing saved shot parameters in a sequence of shots 1302 consistent with certain embodiments of the present disclosure. In some embodiments, the sequence of shots may be included in a practice program. The interface 1300 may comprise shot indications 1302 for each shot in the programed sequence. Each shot indication 1302 may show various information relating to the associated shot including, for example, an indication of a shot location on a playing court, a shot speed, shot spin, and/or the like. The interface 1300 may further display an indication 1306 of a delay between shots in the sequence. A name 1304 of the practice program may further be displayed.

The interface 1300 may comprise a variety of other user controls. For example, the interface 1300 may comprise a program initiation button 1308, an add shot button 1310 for opening a new interface to add a new shot to the sequence, and an upload and/or save button 1312 for saving the sequence and/or uploading the sequence to a service that may storage and/or otherwise manage practice programs.

When a program executes, in some embodiments, the shot indications 1302 may be highlighted to indicate which shot in the sequence has been previously launched by the ball launching system 1204 and/or the next shot in the sequence that will be launched by the ball launching system 1204. In further embodiments, a shot indication 1302 that is associated with a programmed shot that is invalid and/or otherwise not achievable by the ball launching system 1204 may be highlighted and/or otherwise marked in the interface 1300 to indicate to a user that the ball may not land in the desired location.

Figure 14:
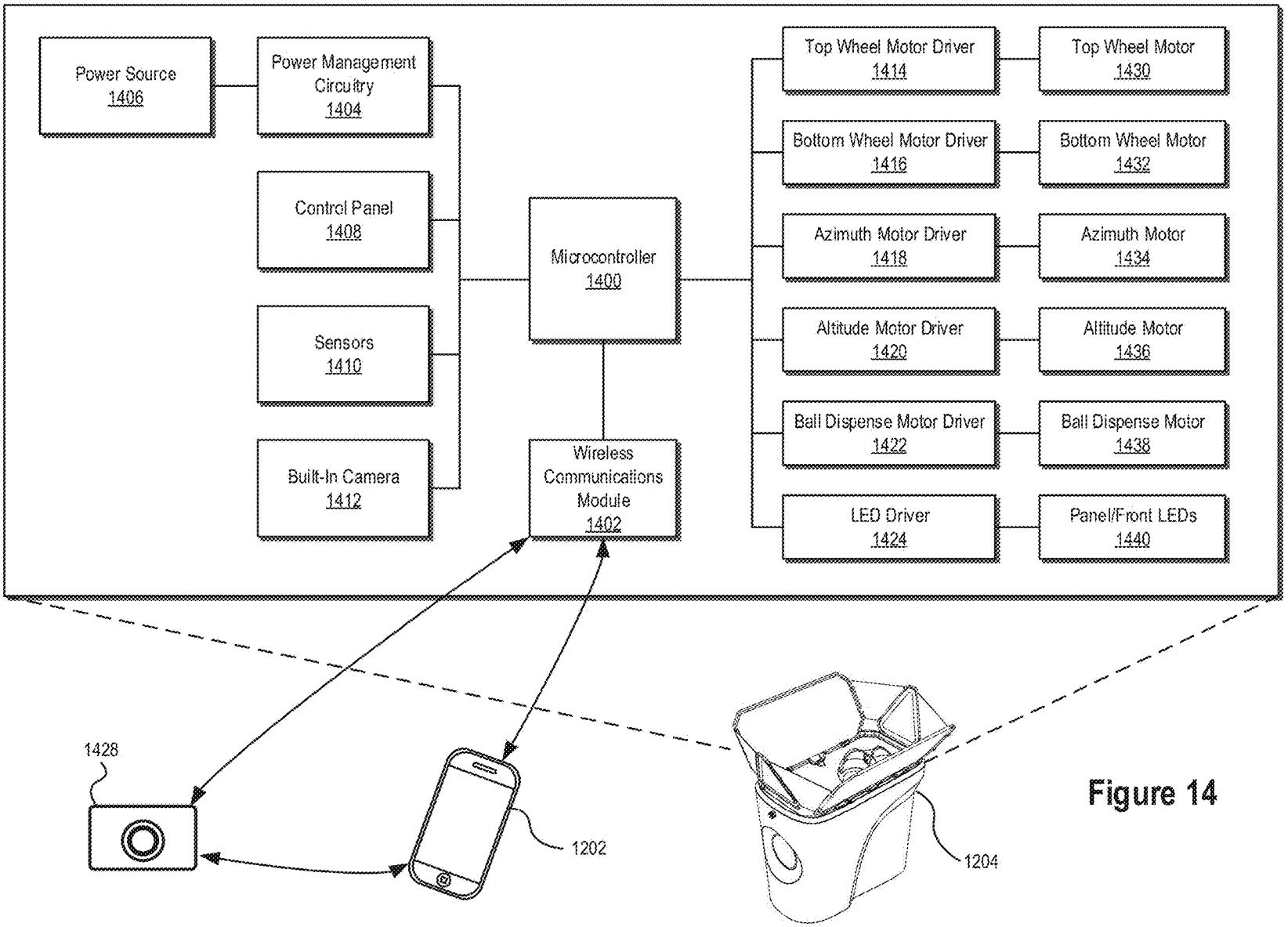
FIG. 14 illustrates a conceptual block diagram of an example of an architecture of a ball launching system consistent with certain embodiments of the present disclosure.

FIG. 14 illustrates a conceptual block diagram of an example of an architecture of a ball launching system 1204 consistent with certain embodiments of the present disclosure. As shown, the ball launching system 1204 may comprise a microcontroller 1400. The microcontroller 1400 may be configured to engage in a variety of control actions associated with the operation of the ball launching system 1204 including, for example and without limitation, coordinating motor control actions based on one or more control instructions received from the mobile device 1202, receiving and acting on various information generated by one or more sensors 1410 of the ball launching system 1204, engaging in actions received from and/or reporting status to a control panel of the ball launching system, and/or the like. Although illustrated as a single microcontroller 1400, it will be appreciated that in further embodiments, a variety of control systems and/or combinations of control systems (e.g., multiple microcontrollers) may be used to implement various aspects of the disclosed systems and methods.

Various components 1400-1424 and 1430-1440 of the illustrated architecture may be interconnected via one on or more power and/or communication busses. Power may be provided to one or more of the components 1400-1404, 1408-1424, and 1430-1440 by a power source 1406 that, in some embodiments, may comprise a removable battery. For example, and without limitation, in certain embodiments, the power source 1406 may comprise a lithium-ion and/or lithium polymer battery pack, although other suitable battery technologies and/or power sources may also be used (e.g., wired power sources). Power management circuity 1404 may be configured to, among other things, manage power provided to one or more components 1400, 1402, 1408-1424, and 1430-1440 by the power source 1406, obtain information relating to charge levels of the power source 1406, generate information relating to the power source 1406 and/or the power consumption of various components 1400, 1402, 1408-1424, and 1430-1440, and/or the like.

The ball launching system 1204 may be communicatively coupled to a mobile device 1202 (and/or an external camera 1428, as described in more detail below) using a wireless communication module 1402. The mobile device 1202, external camera 1428, and/or one or more other devices, systems, and/or services may communicate with the wireless communications module 1402 using a variety of suitable communication protocols and/or standards facilitating communication between the connected devices and systems. For example and without limitation, the mobile device 1202, external camera 1428, and/or one or more other devices, systems, and/or services may communicate with the wireless communications module 1402 of the ball launching system 1204 using, for example and without limitation, IEEE's 802.11 standards, Bluetooth®, ultra-wide band ("UWB"), Zigbee®, a wireless carrier system such as a personal communications system ("PCS"), an analog mobile communications network and/or a digital mobile communications network utilizing, for example, code division multiple access ("CDMA"), Global System for Mobile Communications or Groupe Special Mobile ("GSM"), frequency division multiple access ("FDMA"), time divisional multiple access ("TDMA") standards, and/or any other suitable communication system incorporating any suitable communication standards and/or protocols.

A control panel 1408 may incorporate a variety of suitable user input and/or status notification interfaces, including any of the input and/or status notification interfaces described elsewhere herein. For example and without limitation, in various embodiments, the control panel 1408 may comprise any suitable combination of buttons, knobs, touch panels and/or screens, indicator lights, and/or the like, that may allow a user to, among other things, power on and off the ball launching machine, adjust and/or otherwise configure the machine and/or shot and/or launching parameters, determine machine status (e.g., battery charge status, wireless connectivity status with a mobile device and/or a network, etc.), access, load, configure, and/or initiate practice programs, and/or the like.

The ball launching system 1204 may comprise one or more sensors 1410 that may help enable advanced operations and/or control. The sensors 1410 may comprise any of the sensors described elsewhere herein. In various embodiments, the one or more sensors 1410 may comprise sensors used in connection with the azimuth adjustment mechanism to help ensure repeatability of azimuth positioning operations, the altitude adjustment mechanism to help ensure repeatability of altitude positioning operations, sensors associated with a smart ball feed system to detect a ball prior to launch, motor speed sensors, sensors providing information for identifying when the ball launching system 1204 inadvertently tips over, sensors to detect ball jams, and/or any other sensor configure enable and/or otherwise assist with various operations described herein.

Based on information received from the control panel 1408, the one or more sensors 1410, the mobile device 1202, one or more internal cameras 1412 and/or external cameras 1428 (described in more detail below), and/or other systems and/or services, the microcontroller 1400 may control motor drivers 1414-1422 to, among other things, set the ball speed, spin, launch azimuth angle, launch altitude angle, feed parameters, and/or the like. For example, the top wheel motor driver 1414 may be configured to drive the top wheel motor 1430 and the bottom wheel motor 1416 may be configured to drive the bottom wheel motor 1432. In various embodiments, the speeds which the wheel motor drivers 1414, 1416 drive the wheel motor 1430, 1432 may be varied to achieve a desired launch speed and/or ball spin. For example, to introduce backspin, the bottom wheel motor driver 1416 may drive the bottom wheel motor 1432 at a faster rotational speed than the top wheel motor driver 1414 drives the top wheel motor 1430. To introduce topspin, the bottom wheel motor driver 1416 may drive the bottom wheel motor 1432 at a slower rotational speed than the top wheel motor driver 1414 drives the top wheel motor 1430. To introduce no spin, the drivers 1414, 1416 may drive the respective wheel motors 1400, 1432 at the same and/or similar speeds.

The azimuth motor driver 1418 may be configured to drive an azimuth motor 1434 of an azimuth adjustment mechanism so that the ball launching system 1204 is positioned at a desired azimuth launch angle. The altitude motor driver 1420 may be configured to drive an altitude motor 1436 of an altitude adjustment mechanism so that the ball launching system 1204 is positioned at a desired altitude launch angle.

A ball dispensing motor driver 1422 may be configured to drive one or more ball dispensing motors 1438 that may, among other things, actuate a ball carousel and/or a dispense gate of a ball dispensing mechanism. An LED driver 1424 may be configured to control output LEDs 1440 on the control panel and/or the front of the ball machine (e.g., status indictor lights and/or the like).

In various embodiments, the ball launching machine 1204 may comprise one or more cameras 1412 that may provide information to and/or be controlled by the microcontroller 1400. The camera 1412 may help facilitate a variety of functions. In certain embodiments, the camera 1412 may record where shots landed on a court of play, which may enable the microcontroller 1400 of the ball launching system 1204 to self-calibrate and automatically adjust altitude and/or azimuth angles and/or wheel speeds to accommodate for ball variation, wind, altitude, launching wheel wear, and/or other systematic variation.

The camera 1412 may further track the position of a user on a court. This information may be used by the microcontroller 1400 and/or the mobile device 1202 to automatically generate practice routines and/or drills that place shots just within the reach of the user and/or to provide feedback to a user such as how far they have run during a practice session. The camera 1412 may further provide information indicating how many shots were in in the court and/or in the net. In further embodiments, images and/or video captured by the camera 1412 of a player's movement during a practice routine could be saved and/or uploaded for analysis by, for example, the player, a human coach, an artificial intelligence coaching program, and/or the like.

In further embodiments, an external camera 1428 may be used that may communicate with the wireless communications module 1402 of the ball launching system 1204 directly and/or via the mobile device 1202. In some embodiments, the external camera 1428 may be included and/or otherwise incorporated in the mobile device 1202. A variety of external camera systems 1428 may be used including, for example and without limitation, camera systems 1428 specially configured to track ball positioning in a field of play such as a Hawk-Eye® computerized camera system.

It will be appreciated that a number of variations can be made to the architecture, relationships, and examples presented in connection with FIG. 14 within the scope of the inventive body of work. For example, certain device, system, and/or component functionalities described above may be integrated into a single device, system, and/or component, and/or any suitable combination of devices, systems, and/or components in any suitable configuration. Thus, it will be appreciated that the architecture, relationships, and examples presented in connection with FIG. 14 are provided for purposes of illustration and explanation, and not limitation.

Figure 15:
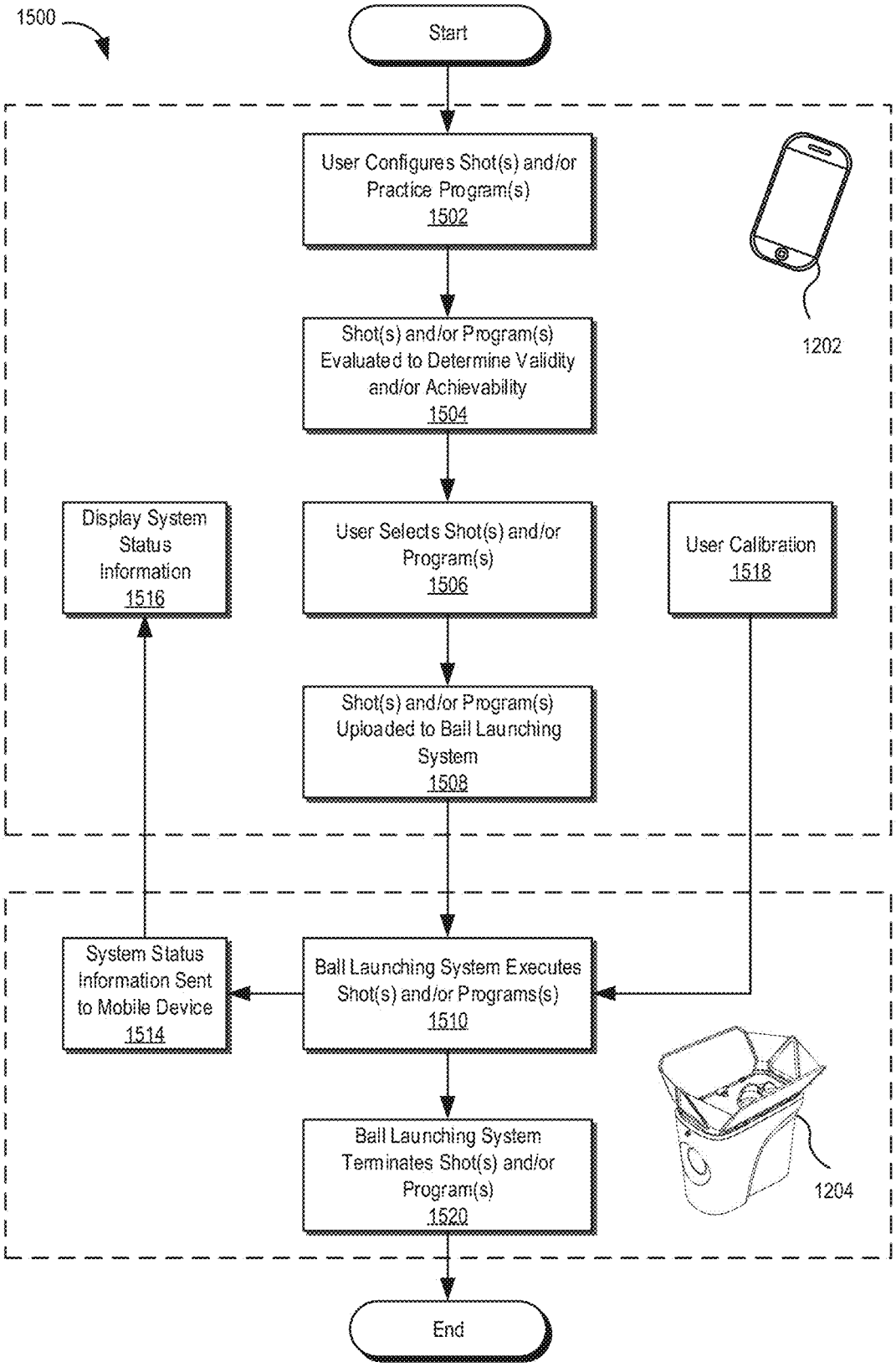
FIG. 15 illustrates a flow chart of an example of a method of interacting with a ball launching system consistent with certain embodiments of the present disclosure.

FIG. 15 illustrates a flow chart of an example of a method 1500 of interacting with a ball launching system 1204 consistent with certain embodiments of the present disclosure. The illustrated method 1500 may be implemented in a variety of ways, including using software, firmware, hardware, and/or any combination thereof. In certain embodiments, various aspects of the method 1500 may be performed by and/or using, for example and without limitation, a ball launching system 1204 and/or a mobile device 1202. For example, as shown, steps 1502-1508, 1516, and 1518 may be performed by and/or using a mobile device 1202, and steps 1510, 1514, and 1520 may be performed by and/or using the ball launching system 1204.

At 1502, a user may configure one or more shots and/or practice programs 1502 using an interface of the mobile device 1202. For example, a user may select one or more shot locations, shot types, and/or other parameters including, for example and without limitation, shot speed and spin (e.g., no spin, top spin, back spin, spin rate, etc.). A user may further designate a time delay between shots. In various embodiments, a user may program and/or otherwise configure a sequence of desired shots for inclusion in a practice program and/or routine. In further embodiments, shots and/or shot sequences may be predefined (e.g., by a manufacturer of the ball launch system 1204), and a user may select from one or more predefined shot routines. In some embodiments, shots and/or shot routines may comprise a random element to provide a less predictable sequence of shots as a difficulty level that may be scaled appropriately to a particular user.

A shot parameter analytics and/or control module executing on the mobile device (and/or the ball launching system 1204 and/or another remote service) may, at 1504, determine whether the shots and/or practice program configured at 1502 are valid and/or otherwise achievable shots based on the capabilities of the ball launching system 1204. For example, using a variety of suitable methods, the mobile device 1202 may determine whether a calculated ball flight path to hit a desired shot location with desired parameters (e.g., spin, spin rate, etc.) is achievable based on the capabilities of the ball launching system 1204.

At 1506, a user may select a particular shot and/or sequence of shots included in a practice program for execution by the ball launching system 1204. Associated control instructions may be communicated to the ball launching system 1204 by the mobile device 1202 at 1508. The ball launching system 1204 may execute the received control instructions, launching shots and/or sequences of shots in accordance with the control instructions at 1510. In various embodiments, status information relating to the operation of the ball launching system 1204 may be communicated to the mobile device 1202 at 5412 and displayed to a user of the mobile device 1202 at 5618. The status information may comprise, for example and without limitation, any of the types of status information described herein including operational conditions, fault and/or error conditions, ball hopper conditions (e.g., empty hopper notifications), shot sequence indications (e.g., indicating which shot in a sequence is being played), system positioning information, a distance a user will need to travel to reach the next shot location, ball launch warnings and/or indications, battery charge status, and/or any other type of status information.

In certain embodiments, a user may send calibration information 1518 to the ball launching system 1204 while shots and/or a sequence of shots are executing to tune and/or otherwise calibrate the operation of the system based on observed performance. As described above, in some embodiments, calibration information may alternatively or additionally be received from an external camera system. The ball launching system 1204 may be configured to run autonomously and/or semi-autonomously until 1520 when its operation is terminated based, for example and without limitation, completing a shot and/or sequence of shots, receiving an indication from an associated sensor that the ball hopper is empty, and/or receiving an indication to terminate operation based on user input. In some embodiments, shot program information may be fully uploaded to the ball launching system 1204 prior to execution and/or individual shot parameters may be uploaded in real time for more granular control by the mobile device 1202.

Figure 16:
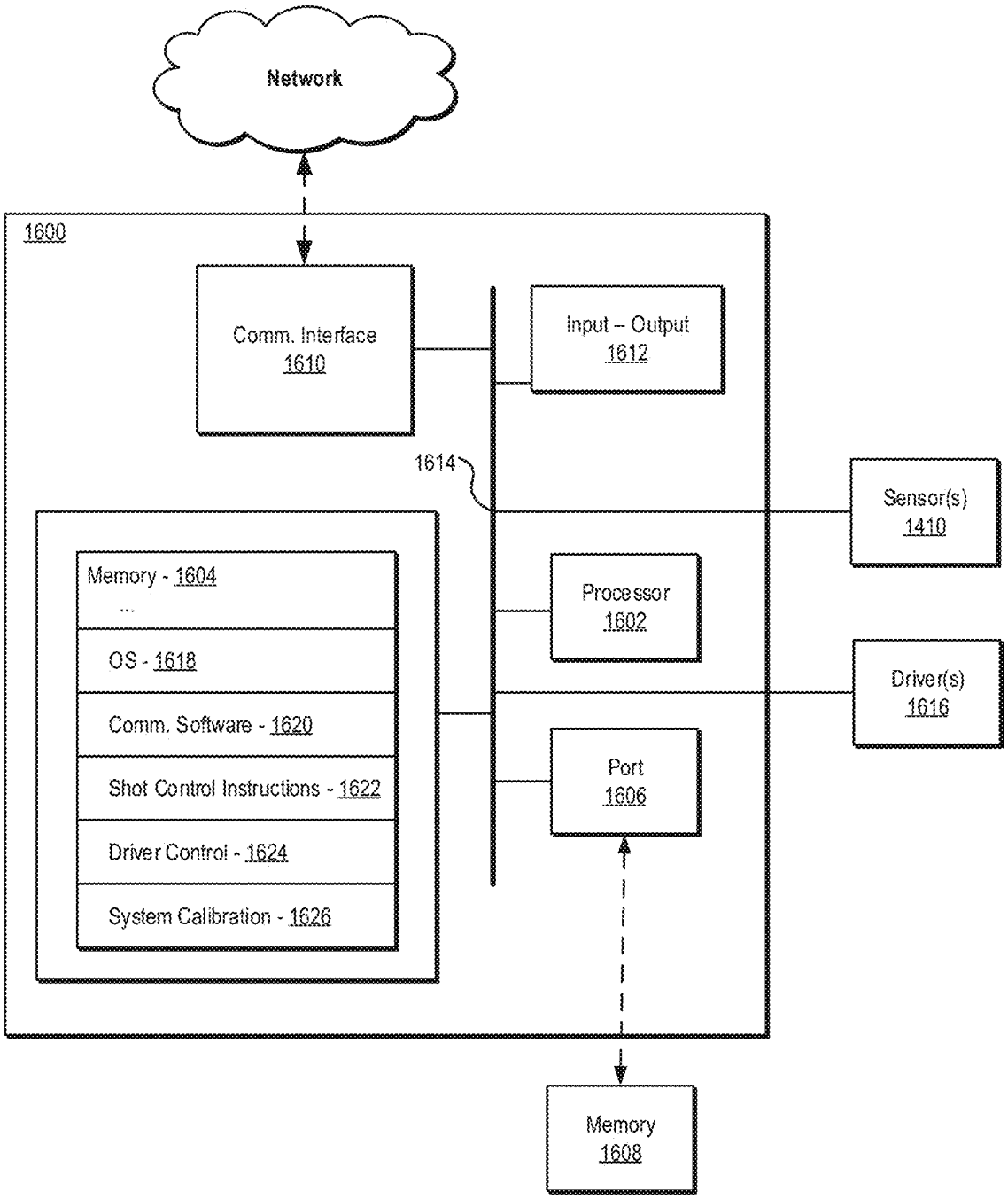
FIG. 16 illustrates a simplified example of a control system that may be used to implement certain aspects of the disclosed systems and associated methods.

FIG. 16 illustrates a simplified example of a control system 1600 that may be used to implement certain aspects of the disclosed systems and associated methods. Certain elements associated with the illustrated control system 1600 may be included in a mobile device, a microcontroller and/or other control system included in a ball launching system, and/or any other system or device configured to implement aspects of the systems and associated methods disclosed herein.

As illustrated in FIG. 16, the control system 1600 may include: a processing unit 1602; memory 1604, which may include high speed random access memory ("RAM"), non-volatile memory ("ROM"), and/or one or more bulk non-volatile non-transitory computer-readable storage mediums (e.g., a hard disk, flash memory, etc.) for storing programs and other data for use and execution by the processing unit 1602; a port 1606 for interfacing with removable memory 1608 (e.g., flash memory, thumb drives, USB dongles, etc.); a communication interface 1610 for communicating with one or more other systems and/or devices using one or more communication technologies, including any of the communication technologies described herein; a user interface 1612 that may include a display, control panel, and/or one or more input/output devices such as, for example, a touchscreen, one or more buttons, and the like; and one or more busses 1616 for communicatively coupling the elements of the control system 1600.

In some embodiments, the control system 1600 may further interface with one or more sensors 1410 and/or drivers 1616 (e.g., wheel motor drivers, altitude and/or azimuth motor drivers, LED drivers, etc.) that may be communicatively coupled to the control system 1600 via the bus 1614 and/or one or more other suitable interfaces.

The operation of the control system 1600 may be generally controlled by the processing unit 1602 operating by executing software instructions and programs stored in the system memory 1604 (and/or other computer-readable media, such as removable memory 1608). The system memory 1604 may store a variety of executable programs or modules for controlling the operation of the system 1600. For example, the system memory 1604 may include an operating system ("OS") 1622 that may manage and coordinate, at least in part, system hardware resources and provide for common services for execution of various system functions.

The system memory 1604 may further include, without limitation, communication software 1624 configured to enable in part communication with and by the control system 1620 (e.g., via communications interface 1610); shot, shot sequence, and/or practice program control instructions 1622, driver control modules 1624 configured to interface with and/or otherwise control one or more drivers 1616, a system calibration module 1626 configured to calibrate the system based on information received from the sensors 1410, a user, and/or one or more other systems (e.g., a camera system); and/or any other information and/or executable modules configured to implement aspects embodiments of the systems and methods disclosed herein.

The foregoing specification has been described with reference to various embodiments, examples, and/or implementations. It will be appreciated that a number of variations can be made to the various embodiments and components presented in connection with the figures within the scope of the inventive body of work, and that the examples presented in the figures are provided for purposes of illustration and explanation, and not limitation. In some instances, benefits, advantages, and/or solutions may have been described above with regard to various embodiments. However, benefits, advantages, solutions, to problems, and/or any element(s) that may cause any benefit, advantage, and/or solution to occur and/or become more pronounced are not to be construed as a critical, a required, or as essential feature and/or element.

It should be noted that there are many alternative ways of implementing both the devices and methods described herein. Accordingly, the present embodiments are to be considered as illustrative and not restrictive, and the invention is not to be limited to the details given herein, but may be modified within the scope and equivalents of the appended claims.

What is claimed is:

1. A ball launching system comprising:

a ball hopper;

a carousel disposed under the ball hopper configured to receive one or more balls from the ball hopper, the carousel defining a plurality of ball dispense position locations, and being coupled to a shared dispense shaft, the shared dispense shaft being configured to actuate the carousel when rotated;

a ball dispensing mechanism configured to receive at least one ball of the one or more balls from the carousel, wherein the ball dispensing mechanism comprises:

a pre-launch chamber disposed under the carousel, the pre-launch chamber being configured to receive the at least one ball from the carousel;

a dispense gate comprising a plurality of radially projecting ball stop tabs, the dispense gate being coupled to the shared dispense shaft such that each radially projecting ball stop tab of the plurality of radially projecting ball stop tabs is substantially aligned with a ball dispense position location of the plurality of ball dispense position locations of the carousel, the shared dispense shaft being configured to actuate the dispense gate when rotated, the dispense gate being configured to hold the at least one ball within the pre-launch chamber until the dispense gate is actuated to feed the at least one ball to a ball dispensing channel; and a dispensing motor configured to rotate the shared dispense shaft and actuate the carousel and the dispense gate; and a launching mechanism configured to receive the at least one ball from the ball dispensing mechanism, the launching mechanism comprising a plurality of motor-driven launching wheels configured to propel the at least one ball from the ball launching system; and an azimuth adjustment mechanism, wherein the azimuth adjustment mechanism comprises at least one fixed motor-driven azimuth adjustment wheel in contact with a ground surface where the ball launching system is resting, the at least one fixed motor-driven azimuth adjustment wheel being configured to be selectively driven by an azimuth adjustment motor configured to change an azimuth orientation of the entire ball launching system relative to a ground surface where the ball launching system is resting when the azimuth adjustment motor is actuated.

2. The ball launching system of claim 1, wherein the ball hopper comprises a plurality of rigid primary panels forming first sides of the ball hopper and a plurality of rigid secondary panels forming second sides of the ball hopper, the plurality of rigid primary panels each comprising a rigid frame and an inner panel face material.

3. The ball launching system of claim 1, wherein the ball launching system further comprises a ball detection sensor disposed proximate to the pre-launch chamber configured to detect whether a ball is present in the pre-launch chamber.

4. The ball launching system of claim 3, wherein the ball launching system further comprises control electronics, the control electronics being configured to actuate the dispensing motor when the ball detection sensor detects that a ball is present in the pre-launch chamber and a control signal to launch a ball is received from a mobile device in communication with the ball launching system.

5. The ball launching system of claim 4, wherein the control electronics are further configured to shut off the plurality of motor-driven wheels if the ball detection sensor has not detected that a ball is present in the pre-launch chamber for a predetermined time period.

6. The ball launching system of claim 4, wherein the ball launching system further comprises a ball jam detection sensor disposed proximate to the carousel configured to detect the occurrence of a ball jam condition.

7. The ball launching system of claim 6, wherein the control electronics are further configured to reverse a rotational direction of the dispensing motor when the ball jam detection sensor detects the occurrence of a ball jam condition.

8. The ball launching system of claim 1, wherein the carousel comprises a multi-piece carousel selectively configurable between an operating configuration and a storage configuration, the multi-piece carousel comprising a top piece and a bottom piece, the top piece being configured to nest within the bottom piece when the carousel is configured in a storage configuration.

9. The ball launching system of claim 1, wherein the ball launching system further comprises:

an altitude adjustment mechanism configured to selectively adjust an angle of a base of the ball launching system relative to a ground surface where the ball launching system is resting.

10. The ball launching system of claim 1, wherein the ball launching system further comprises control electronics, the control electronics being configured to actuate a first launching wheel motor configured to drive a first motor-driven launching wheel of the plurality of motor-driven launching wheels and a second launching wheel motor configured to drive a second motor-driven launching wheel of the plurality of motor-driven launching wheels based, at least in part, on a control signal received from a mobile device in communication with the ball launching system, the actuating comprising at least one of:

rotating at least one of the first launching wheel motor and the second launching wheel motor at a particular speed; and actively breaking at least one of the first launching wheel motor and the second launching wheel motor.

11. The ball launching system of claim 10, wherein the control electronics are further configured to adjust a rotational speed of at least one of the first launching wheel motor and the second launching wheel motor based, at least in part, on feedback information provided by a closed-loop feedback system.

12. The ball launching system of claim 1, wherein the ball launching system further comprises control electronics configured to adjust an operating parameter of the ball launching system based, at least in part, on information received from a camera system, wherein the camera system comprises at least one of a camera system internal to the ball launching system and separate camera system in communication with the ball launching system.

13. The ball launching system of claim 1, wherein the at least one fixed motor-driven azimuth adjustment wheel is directly driven by the azimuth adjustment motor.

14. The ball launching system of claim 1, wherein at the least one fixed motor-driven azimuth adjustment wheel is driven by the azimuth adjustment motor via a gear reduction mechanism.

15. A ball launching system comprising:

a ball hopper configured to store a plurality of balls;

a carousel disposed under the ball hopper configured receive one or more balls from the ball hopper, the carousel defining a plurality of ball dispense position locations and being coupled to a shared dispense shaft, the shared dispense shaft being configured to actuate the carousel when rotated;

a ball dispensing mechanism configured to receive at least one ball of the one or more balls from the carousel, the ball dispensing mechanism configured to be actuated by the shared dispense shaft when the shared dispense shaft is rotated, wherein the ball dispensing mechanism comprises:

a pre-launch chamber disposed under the carousel, the pre-launch chamber being configured to receive the at least one ball from the carousel, a dispense gate comprising a plurality of radially projecting ball stop tabs, the dispense gate being coupled to the shared dispense shaft such that each radially projecting ball stop tab of the plurality of radially projecting ball stop tabs is substantially aligned with a ball dispense position location of the plurality of ball dispense position locations of the carousel;

a ball dispensing channel configured to receive the at least one ball from the pre-launch chamber; and a launching mechanism configured to receive the at least one ball from the ball dispensing channel, the launching mechanism comprising a plurality of motor-driven wheels configured to propel the at least one ball from the ball launching system.

16. The ball launching system of claim 15, wherein the dispense gate is configured to hold the at least one ball within the pre-launch chamber until the dispense gate is actuated to feed the at least one ball to the ball dispensing channel.

17. The ball launching system of claim 16, wherein the ball launching system further comprises a dispensing motor configured to rotate the shared dispense shaft and actuate the carousel and the dispense gate.

18. The ball launching system of claim 17, wherein the ball launching system comprises a ball detection sensor disposed proximate to the pre-launch chamber configured to detect whether a ball is present in the pre-launch chamber.

19. The ball launching system of claim 18, wherin the ball launching system further comprises control electronics, the control electronics being configured to actuate the dispensing motor when the ball detection sensor detects that a ball is present in the pre-launch chamber and a control signal to launch a ball is received from a mobile device in communication with the ball launching system.

20. The ball launching system of claim 15, wherein the ball hopper comprises at least three rigid primary panels forming first sides of the ball hopper and at least three rigid secondary panels forming second sides of the ball hopper, the at least three rigid primary panels each comprising a rigid frame and an inner panel face material.

21. The ball launching system of claim 15, wherein the ball launching system further comprises:

an azimuth adjustment mechanism, wherein the azimuth adjustment mechanism comprises at least one fixed motor-driven azimuth adjustment wheel in contact with a ground surface where the ball launching system is resting and an azimuth adjustment motor configured to selectively drive the at least one fixed motor driven azimuth adjustment wheel and change an azimuth orientation of a base of the ball launching system relative to the ground service; and an altitude adjustment mechanism configured to selectively adjust an angle of base of the ball launching system relative to the ground surface.

* * * * *